US005124241A

United States Patent [19]

Ogawa et al.

[11] Patent Number: 5,124,241

[45] Date of Patent: Jun. 23, 1992

[54] SILVER HALIDE COLOR PHOTOGRAPHIC MATERIAL

[75] Inventors: Akira Ogawa; Nobuo Sakai; Ryosuke Ishida, all of Minami-Ashigara, Japan

[73] Assignee: Fuji Photo Film Co., Ltd., Kanagawa, Japan

[21] Appl. No.: 599,850

[22] Filed: Oct. 19, 1990

[30] Foreign Application Priority Data

Oct. 19, 1989 [JP] Japan ..... 1-270191

[51] Int. Cl.[5] ..... G03C 7/34

[52] U.S. Cl. ..... 430/505; 430/549; 430/553

[58] Field of Search ..... 430/549, 552, 553, 505

[56] References Cited

U.S. PATENT DOCUMENTS

| | | | |
|---|---|---|---|
| 3,772,002 | 11/1973 | Ramello | 430/553 |
| 4,581,324 | 4/1986 | Wolff et al. | 430/553 |
| 4,686,177 | 8/1987 | Aoki et al. | 430/553 |
| 4,837,136 | 6/1989 | Ichijima et al. | 430/553 |
| 4,863,840 | 9/1989 | Komorita et al. | 430/553 |
| 4,971,898 | 11/1990 | Aoki et al. | 430/549 |
| 5,009,989 | 4/1991 | Aoki et al. | 430/549 |
| 5,011,764 | 4/1991 | Sakai et al. | 430/553 |
| 5,028,515 | 7/1991 | Hasebe et al. | 430/553 |

*Primary Examiner*—Richard L. Schilling

*Attorney, Agent, or Firm*—Birch, Stewart, Kolasch & Birch

[57] ABSTRACT

There are disclosed a multilayer silver halide color photographic material comprising two kinds of cyan couplers and a multilayer silver halide color photographic material comprising two kinds of cyan couplers, a magenta coupler, and a yellow coupler in respective photosensitive layer. The disclosure as described provides a multilayer silver halide color photographic material that is good in color-forming property, that will be less stained, and that is improved in image-lasting quality and in fastness under severe conditions.

12 Claims, No Drawings

SILVER HALIDE COLOR PHOTOGRAPHIC MATERIAL

FIELD OF THE INVENTION

The present invention relates to multilayer silver halide photographic materials, and in particular to a multilayer silver halide photographic material (hereinafter referred to as photographic material) good in color-forming property and improved in the prevention of cyan staining in the white background and in image-lasting property.

BACKGROUND OF THE INVENTION

Silver halide color photographic materials have a multilayer constitution of photosensitive layers that are made up of at least three silver halide emulsion layers different in color sensitivity, which are applied on a base. For instance, so-called color photographic papers (hereinafter referred to as color papers) generally are coated with a red-sensitive emulsion layer, a green-sensitive emulsion layer, and a blue-sensitive emulsion layer in this order from the side where exposure will be made. And further, color papers have color-mixing preventing and ultraviolet-absorbing intermediate layers, protective layers, etc., interposed between the photographic layers.

Further, in the case of color positive film, generally a green-sensitive emulsion layer, a red-sensitive emulsion layer, and a blue-sensitive emulsion layer are applied in this order from the side farthest from the base, that is, in this order from the side where exposure will be made. In color negative films, there are a variety of orders for the arrangement of layers, and although generally a blue-sensitive emulsion layer, a green-sensitive emulsion layer, and a red-sensitive emulsion layer in this order from the side where exposure will be made, among the photographic materials having two or more emulsion layers that have the same color sensitivity but are different in sensitivity, there are also found photographic materials wherein emulsion layers different in color sensitivity are arranged between the said two or more emulsion layers and a bleachable yellow filter layer, an intermediate layer, a protective layer, etc., are interposed.

In order to form a color photographic image, three photographic couplers, that is, a yellow coupler, a magenta coupler, and a cyan coupler, are incorporated in photosensitive layers, and the photographic material that has been exposed to light is subjected to color development processing with a so-called color-development agent. The oxidized product of the aromatic primary amine is coupled with the couplers to give color-formed dyes, and it is preferable that the coupling speeds of the couplers are as high as possible and that the couplers are good in color-forming properties, to give high color-formed densities within a limited period of development time. It is required that the color-formed are bright cyan, magenta, and yellow dyes low in subsidiary absorption and that they give a color photographic image good in color reproduction quality.

On the other hand, the formed color photographic image must be good in keeping quality under various conditions. In order to meet this requirement, it is important that the color-formed dyes different in hue are slow in fading or discoloration speed and that the speeds of the fading over all of the image density are aligned as much as possible, so that the color balance of the remaining dye image does not change.

On the other hand, it is also important that staining does not take place in the white background after the development processing. Particularly, in the case of color papers, color formation of cyan staining likely occurs in the white background and its improvement is desired.

In prior photographic materials. and in particular in color papers, for cyan couplers good in color-forming property, staining is liable to occur in the unexposed part and deterioration of the cyan color image is great due to light fading or long-term dark fading under the influence of humidity and heat, so that the color balance is apt to change, and therefore its improvement is keenly desired. Accordingly, cyan couplers that are good in color-forming property, that cause less occurrence of cyan staining, and that are excellent in image-lasting quality (image preserving property) are demanded.

In order to partially overcome these problems partially, various couplers and, in particular, cyan couplers and combinations thereof, are suggested conventionally.

Examples thereof are described, for example, in JP-A ("JP-A" means unexamined published Japanese patent application) Nos. 50136/1986, 57238/1984, 205446/1985, and 4047/1986, U.S. Pat. No. 4,607,002, JP-A Nos. 166339/1987, 173464/1987, and 167361/1988, U.S. Pat. Nos. 4,748,100 and 4,622,287, and JP-A Nos. 222852/1985 and 200037/1982.

However, in the case of these couplers or combinations thereof, the color forming property of the cyan coupler and prevention of stain both are not secured, and further, since fading of the cyan dye part becomes great along with deterioration due to light and heat, the color balance changes, and therefore these problems have not yet been overcome totally.

BRIEF SUMMARY OF THE INVENTION

The present invention intends to solve the above problems simultaneously, ad more specifically the object of the present invention is to provide a multilayer silver halide color photographic material that is good in color-forming property, that will be less stained, and that is improved in image-lasting quality, and particularly whose color balance will not change for a long period of time either in dark and under light, and more particularly, a multilayer silver halide color photographic material in which the image will not fade even if it is kept under severe conditions under light.

Other and further objects, features, and advantages of the invention will appear more fully from the following description.

DETAILED DESCRIPTION OF THE INVENTION

The object of the present invention is attained effectively by the photographic material given below.

(1) A silver halide color photographic material, characterized in that it contains at least one cyan coupler represented by formula (I-A) given below and at least one cyan coupler represented by formula (I-B) given below.

(2) A silver halide color photographic material having at least three photosensitive silver halide emulsion layers different in color sensitivity on a base, characterized in that a first color-sensitive photosensitive layer contains at least one cyan coupler represented by formula (I-A) given below and at least one cyan coupler represented by formula (I-B) given below, a second color-sensitive photosensitive layer contains at least one magenta coupler represented by formula (II) given below, and a third color-sensitive photographic layer contains at least one yellow coupler represented by formula (III) given below.

Formula (I-A):

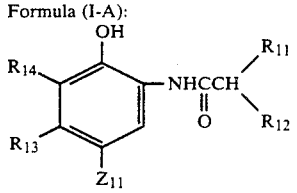

wherein $R_{11}$ and $R_{12}$ each represent an alkyl group with the total number of carbon atoms in the alkyl groups $R_{11}$ and $R_{12}$ being 12 to 36, $R_{13}$ represents an alkyl group having 2 or more carbon atoms, $R_{14}$ represents a hydrogen atom, a halogen atom, an alkyl group, an aryl group, an alkoxy group, or an acylamino group, and $Z_{11}$ represents a hydrogen atom or a group or an atom that is capable of being released upon coupling reaction in which the coupler couples with the oxidized product of an aromatic primary amine color-developing agent.

Formula (I-B):

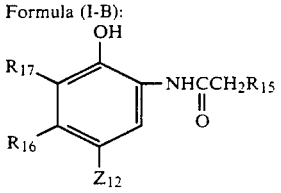

wherein $R_{15}$ represents an alkyl group having 8 or more carbon atoms, $R_{16}$ represents an alkyl group having 2 or more carbon atoms. $R_{17}$ represents a hydrogen atom, a halogen atom, an alkyl group, an aryl group, an alkoxy group, or an acylamino group, and $Z_{12}$ represents a hydrogen atom or a group or an atom that is capable of being released upon coupling reaction in which the coupler couples with the oxidized product of an aromatic primary amine color-developing agent.

Formula (II):

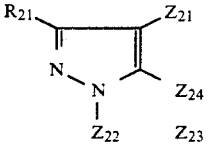

wherein $R_{21}$ represents a hydrogen atom or a group capable of substitution, $Z_{21}$ represents a hydrogen atom or a group or an atom that is capable of being released upon coupling reaction which the coupler couples with the oxidized product of an aromatic primary amine developing agent, $Z_{22}$, $Z_{23}$, and $Z_{24}$ each represent

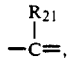

—N=, or —NH—, one of $Z_{24}$–$Z_{23}$ bond and the $Z_{23}$–$Z_{22}$ bond is a double bond, the other is a single bond, and when $Z_{23}$–$Z_{22}$ is a carbon-carbon double bond, it may be part of the aromatic ring.

Formula (III):

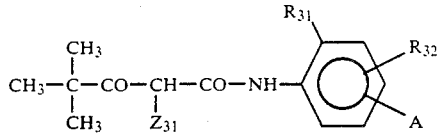

wherein $R_{31}$ represents a halogen atom, an alkoxy group, a trifluoromethyl group, or an aryl group, $R_{32}$ represents a hydrogen atom, a halogen atom, or an alkoxy group, A represents —$NHCOR_{33}$, —$NHSO_2$—$R_{33}$, —$SO_2NHR_{33}$, —$COOR_{33}$, or

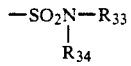

in which $R_{33}$ and $R_{34}$ each represent an alkyl group, an aryl group, or an acyl group, and $Z_{31}$ have the same meaning as that of $Z_{21}$.

In this specification and claims it should be understood that an alkyl group (an alkyl residue), an aryl group (an aryl residue), a heterocyclic group (a heterocyclic residue), a sulfonyl group (a sulfonyl residue), and the like are used to include unsubstituted ones as well as substituted ones.

Formulae (I-A) and (I-B) will now be described in more detail.

In formula (I-A), $R_{11}$ and $R_{12}$ each represent an alkyl group having preferably 6 to 18 carbon atoms, respectively, the total number of carbon atoms of the alkyl groups represented by $R_{11}$ and $R_{12}$ is 12 to 36, preferably 14 to 22, the alkyl group may be substituted but particularly preferably the alkyl group is an unsubstituted alkyl group, and examples of the alkyl group are a straight-chain alkyl group (e.g., methyl, ethyl, propyl, butyl, hexyl, pentyl, octyl, nonyl, decyl, dodecyl, tridecyl, tetradecyl, pentadecyl, octadecyl, and nonadecyl) and a branched alkyl group (e.g., 1-methylethyl, 1,1-dimethylethyl, 2-methylpropyl, 2,2-dimethylpropyl, 1,3,3-trimethylbutyl, 3,5,5-trimethylhexyl, 2-ethylhexyl, 4,4-dimethylpentyl, 1,3,5,5-tetramethyloctyl, 2,3,5-trimethyl-5-ethyldecyl, 1-methyl-3-ethylhexyl, 1,1,3,3-tetramethylbutyl, 1,1-dimethylbutyl, 1,1-dimethylpropyl, 1,1-dimethylhexyl, 1,1-diethylhexyl, and 3,3-dimethyl-2-i-propylbutyl).

$R_{15}$ represents an alkyl group having 8 to 30 carbon atoms, preferably 12 to 20 carbon atoms, more preferably 14 to 18 carbon atoms, the alkyl group may be substituted but particularly preferably the alkyl group is an unsubstituted alkyl group, and examples of the alkyl group are a straight-chain alkyl group (e.g., octyl, nonyl, decyl, undecyl, dodecyl, tridecyl, tetradecyl, pentadecyl, hexadecyl, heptadecyl, octadecyl, and nonadecyl) and a branched alkyl group (e.g., 3,5,5-trimethylhexyl, 2-ethylhexyl, 1,3,5,5-tetramethyloctyl, 2,3,5-trimethyl-5-ethyldecyl, and 1-methyl-3-ethylhexyl).

$R_{13}$ and $R_{16}$ each represent an alkyl group having 2 or more carbon atoms, preferably 2 to 6 carbon atoms, the alkyl group may be substituted but particularly preferably the alkyl group is an unsubstituted alkyl group, and examples of the alkyl group are an ethyl group, a propyl group, an i-propyl group, a butyl group, an i-butyl group, a t-butyl group, and a hexyl group.

$R_{14}$ and $R_{17}$ each represent a hydrogen atom, a halogen atom (e.g., chlorine, bromine, and fluorine), an alkyl group having 1 to 8 carbon atoms, preferably 1 to 3 carbon atoms (e.g., methyl. ethyl, and propyl), an aryl group having 6 to 12 carbon atoms, preferably 6 to 7 carbon atoms (e.g., phenyl and p-chlorophenyl), an alkoxy group having 1 to 8 carbon atoms, preferably 1 to 3 carbon atoms (e.g., methoxy and ethoxy), or an acylamido group having 2 to 10 carbon atoms, preferably 2 to 4 carbon atoms (e.g., acetamido and methanesulfonamido).

$Z_{11}$ and $Z_{12}$ each represent a hydrogen atom or a group capable of released upon coupling reaction and examples thereof are a halogen atom (e.g., fluorine, chlorine, and bromine), an alkoxy group (e.g., dodecyloxy, methoxycarbamoylmethoxy, carboxypropyloxy, and methylsulfonylethoxy), an aryloxy group (e.g., 4-chlorophenoxy and 4-methoxyphenoxy), an acyloxy group (e.g., acetoxy, tetradecanoyloxy, and benzoyloxy), a sulfonyloxy group (e.g., methanesulfonyloxy and toluenesulfonyloxy), an amido group (e.g., dichloroacetylamino, methanesulfonylamino, and toluenesulfonylamino), an alkoxycarbonyloxy group (e.g., ethoxycarbonyloxy and benzyloxycarbonyloxy), an aryloxycarbonyloxy group (e.g., phenoxycarbonyloxy), an aliphatic or aromatic thio group (e.g., phenylthio and tetrazolylthio), an imido group (e.g., succinimido and hydantoinyl), and an N-heterocyclic group (e.g., 1-pyrazolyl and 1-benztriazolyl).

The coupler of formula (I-a) or (I-b) may form a dimer or more higher polymer.

Now formula (II) will be described in detail.

In formula (II), $R_{21}$ represents a hydrogen atom or a substituent, $Z_{21}$ represents a hydrogen atom or a group capable of being released, and $Z_{22}$, $Z_{23}$, and $Z_{24}$ each represent $$-\overset{\overset{R_{21}}{|}}{C}=,$$

—N=, or —NH—, one of $Z_{24}$–$Z_{23}$ bond and $Z_{23}$–$Z_{22}$ bond is a double bond, the other is a single bond. And when $Z_{23}$–$Z_{22}$ is a carbon-carbon double bond, the case being part of the aromatic ring is included.

In formula (II), $R_{21}$ represents preferably a hydrogen atom, a halogen atom, an alkyl group, an aryl group, a heterocyclic group, a cyano group, an alkoxy group, an aryloxy group, a heterocyclicoxy group, an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, heterocyclylthio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group.

These substituents will be described in more detail. $R_{21}$ represents a hydrogen atom, a halogen atom (e.g., chlorine atom and bromine atom), an alkyl group (e.g., methyl, propyl, t-butyl, trifluoromethyl, tridecyl, 3-(2,4-di-t-amylphenoxy)propyl, allyl, 2-dodecyloxyethyl, 3-phenoxypropyl, 2-hexylsulfonylethyl, cyclopentyl, and benzyl), an aryl group (e.g., phenyl, 4-t-butylphenyl, 2,4-di-t-amylphenyl, and 4-tetradecaneamidophenyl), a heterocyclic group (e.g., 2-furyl, 2-thienyl, 2-pyrymidinyl. and 2-benzothiazolyl), a cyano group, an alkoxy group (e.g., methoxy, ethoxy, 2-methoxyethoxy, 2-dodecyloxyethoxy, add 2-methanesulfonylethoxy), an aryloxy group (e.g., phenoxy, 2-methylphenoxy, and 4-t-butylphenoxy), a heterocyclicoxy group (e.g., 2-benzimidazolyloxy), an acyloxy group (e.g., acetoxy and hexadecanoyloxy), a carbamoyloxy group (e.g., N-phenylcarbamoyloxy and N-ethylcarbamoyloxy), a silyloxy group (e.g., trimethylsilyloxy), a sulfonyloxy group (e.g., dodecylsulfonyloxy), an acylamino group (e.g., acetamido, benzamido, tetradecanamido, and α-(2,4-di-t-amylphenoxy)buthyramido, γ-(3-t-butyl-4-hydroxyphenoxy)buthyramido, and 60 -{4-(4-hydroxyphenylsulfonyl)-phenoxy}decaneamido), an anilino group (e.g., phenylamino, 2-chloroanilino, 2-chloro-5-tetradecaneamidoanilino, 2-chloro-5-dodecyloxycarbonylanilino, N-acethylanilino, and 2-chloro-5-{α-(3-t-butyl-4-hydroxyphenoxy)-dodecaneamido}anilino), an ureido group (e.g., phenylureido, methylureido, and N,N-dibutylureido), an imido group (e.g., N-succinimido, 3-benzylhydantoinyl, and 4-(2-ethylhexanoylamino)phthalimido), a sulfamoylamino group (e.g., N,N-di-propylsulfamoylamino and N-methyl—N-decylsulfamoylamino), an alkylthio group (e.g., methylthio, octylthio, tetradecylthio, 2-phenoxyethylthio, 3-phenoxypropylthio, and 3 (4 t-butylphenoxy)propylthio), an arylthio group (e.g., phenylthio, 2-butoxy-5-t-octylphenylthio, 3 pentadecylphenylthio, 2-carboxyphenylthio, and 4-tetradecaneamidophenylthio), a heterocyclicthio group (e.g., 2-benzothiazolylthio), an alkoxycarbonylamino group (e.g., methoxycarbonylamino and tetradecyloxycarbonylamino), an aryloxycarbonylamino group (e.g., phenoxycarbonylamino and 2,4-di-tertbutylphenoxycarbonylamino), a sulfonamido group (e.g., methanesulfonamido, hexadecanesulfonamido, benzenesulfonamido, p-toluenesulfonamido, octadecanesulfonamido, and 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl—N-dodecylcarbamoyl, and N-{3-(2,4-di-tertamylphenoxy)-propyl}carbamoyl), an acyl group (e.g., an acetyl group, (2,4-di-tert-amylphenoxy)acetyl, and benzoyl), a sulfamoyl group (e.g., N-ethylsulfamoyl, N,N dipropylsulfamoyl, N-(2-dodecyloxyethyl)sulfamoyl, N-ethyl—N-dodecylsulfamoyl, and N,N-diethylsulfamoyl), a sulfonyl group (e.g., methanesulfonyl, octanesulfonyl, benzenesulfonyl, toluenesulfonyl, and 2-butoxy-5-tertoctylphenylsulfonyl), a sulfinyl group (e.g., octanesulfinyl, dodecylsulfinyl, and phenylsulfinyl), an alkoxycarbonyl group (e.g., methoxycarbonyl, butyloxycarbonyl, dodecylcarbonyl, and octadecylcarbonyl) or an aryloxycarbonyl group (e.g., phenyloxycarbonyl and 3-pentadecyloxycarbonyl).

Examples of group capable of being released represented by $Z_{21}$ that can be mentioned include a halogen atom (e.g., fluorine, chlorine, and bromine), an alkoxy group (e.g., dodecyloxy, dodecyloxycarbonylmethoxy, methoxycarbamoylmethoxy, carboxypropyloxy, and methanesulfonyloxy), an aryloxy group (e.g., 4-methylphenoxy, 4-tert-butylphenoxy, 4-methoxyphenoxy, 4-methanesulfonylphenoxy, and 4-(4-benzyloxyphenylsulfonyl)phenoxy), an acyloxy group (e.g., acetoxy, tetradecanoyloxy, and benzoyloxy), a sulfonyloxy group (e.g., methanesulfonyloxy and toluenesulfonyloxy), an amido group (e.g., dichloroacetylamino, methanesulfonylamino, and triphenylphosphoneamido), an alkoxycarbonyloxy group (e.g., ethoxycarbonyloxy and benzyloxycarbonyloxy), an aryloxycarbonyloxy group (e.g., phenoxycarbonyloxy), an aliphatic or aromatic thio group (e.g., phenylthio, dodecylthio, benzylthio, 2-butoxy-5-tertoctylphenylthio, 2-(2-ethoxyethoxy)-5-tertoctylphenylthio, and tetrazolylthio), an imido group (e.g., succinimido, hydantoinyl, 2,4-dioxooxazolyzine-3-yl, and 3-benzyl-4-ethoxyhydantoin-1-yl), N-heterocyclic group (e.g., 1-pyrazolyl, 1-benztriazolyl, and 2,4-triazole-1-yl).

Preferably, at least one of $R_{21}$ is a ballast group. $R_{21}$ and $Z_{21}$ of formula (II) may form a dimer or more higher polymer.

Now formula (III) will be described in detail.

In formula (III), $R_{31}$ represents a halogen atom (e.g., chlorine atom and bromine atom), an alkoxy group (e.g., methoxy, ethoxy, decyloxy, and hexadecyloxy), a trifluoromethyl group or an aryl group (e.g., phenyl and p-chlorophenyl), $R_{32}$ represents a hydrogen atom, a halogen atom (e.g., chlorine atom and bromine atom) or an alkoxy group (e.g., methoxy and ethoxy), and A represents —$NHCOR_{33}$, —$NHSO_2$—$R_{33}$, —$SO_2NHR_{33}$, —$COOR_{33}$, or $$-SO_2\underset{\underset{R_{34}}{|}}{N}-R_{33}$$

in which $R_{33}$ and $R_{34}$ each represent an alkyl group, an aryl group, or an acyl group. The carbon numbers of $R_{33}$ and $R_{34}$ are preferably 10 to 32.

In formula (III), $R_{31}$ or A may be a ballasting group, by which is meant a group having a molecular weight large enough to render the coupler immobile in the photosensitive layer to which the coupler is added; preferably the ballasting group is a group having 8 or more carbon atoms, more preferably 10 or more carbon atoms.

Preferable examples of $R_{31}$ as the ballasting group include a group $R_3O$— ($R_3$ represents an alkyl group having 10 to 32 carbon atoms), and preferable examples of A as the ballasting group include —$COOR_{33}$, —$NHCOR_{33}$—, —$NHSO_2$—$R_{33}$, and $$-SO_2\underset{\underset{R_{34}}{|}}{N}-R_{33},$$

in which $R_{33}$ and $R_{34}$ represents an alkyl group or an acyl group each having 10 to 32 carbon atoms. These $R_{33}$ and $R_{34}$ may be further substituted, and specific examples of the substituent include a substituted phenoxy group (e.g., 2,4-di-tertamylphenoxy, 4-tert-amyl-2-chlorophenoxy, 4-n-butanesulfonamidophenoxy, 2-n-butylsulfamoylphenoxy, 3-n-pentadecylphenoxy, and 2-cyanophenoxy), an alkoxy group (e g., methoxy and octylphenoxy), an alkoxycarbonyl group (e.g., octyloxycarbonyl), and a sulfonamido group (e.g., hexadecanesulfonamido).

$R_4$ represents a hydrogen atom or an alkyl group (e.g., methyl, ethyl, and propyl).

$R_{32}$ represents a halogen atom (e.g., chlorine, bromine, and fluorine) or an alkoxy group (e.g., methoxy, ethoxy, and propoxy).

The coupling split-off group represented by $Z_{31}$ has the same meaning as that of $Z_{11}$, and specifically, it is a group preferably represented by formula (A) or (B) given below.

Formula (A):

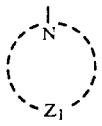

wherein $Z_1$ represents a group of nonmetal atoms required to complete a 5- or 6-membered ring together with the nitrogen atom bonded to the active point. Specific examples of the 5- or 6-membered heterocyclic ring represented by

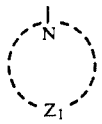

include the following skeletons:

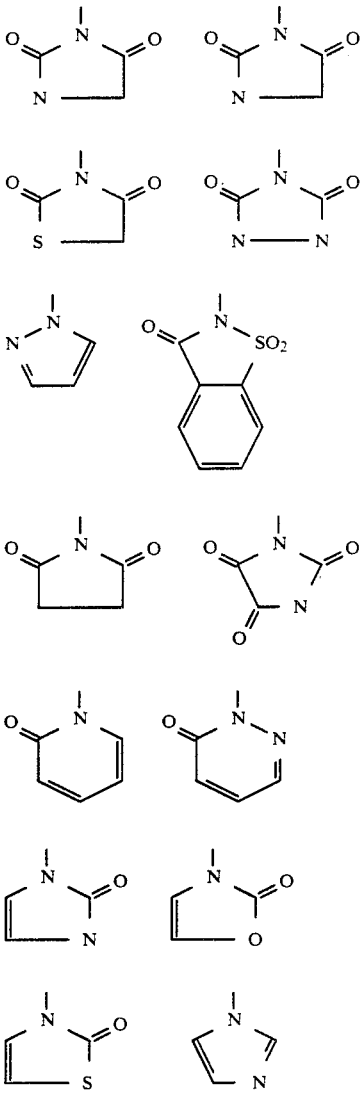

-continued

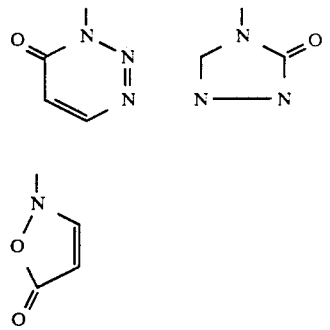

The nitrogen atom or the carbon atom of these heterocyclic rings may have a substitutable substituent. As specific examples thereof, an alkyl group (e.g. methyl, ethyl, and ethoxyethyl), an aryl group (e.g. phenyl and 4-chlorophenyl), an aralkyl group (e.g. benzyl), an alkoxy group (e.g. methoxy and ethoxy), a halogen atom (e.g. chlorine), an acylamino group (e.g. acetamido), a sulfonamido group (e.g. methanesulfonamido), a sulfonyl group, a sulfamoyl group, a carbamoyl group, a carboxyl group, an alkoxycarbonyl group, a hydroxyl group, a nitro group, a cyano group, and an alkenyl group (e.g. vinylmethyl) can be mentioned.

Formula (B):

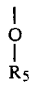

wherein $R_5$ represents an aryl group. Specific examples of the aryl group are a phenyl group and a naphthyl group, which may be substituted. Specific examples of the substituent are a halogen atom (e.g. chlorine), an alkyl group (e.g. methyl), an alkoxy group (e.g. methoxy), an acylamido group (e.g. acetamido), a sulfonamido group (e.g. methanesulfonamido), a sulfonyl group (e.g. methylsulfonyl and 4-hydroxyphenylsulfonyl), a sulfamoyl group, a carbamoyl group, a carboxyl group, an alkoxycarbonyl group, a hydroxyl group, a cyano group, and a nitro group.

Of the cyan couplers represented by formula (I-A), preferable ones are those represented by formula (IV-A) given below, and of the cyan couplers represented by formula (IV-B), preferable ones are those represented by formula (IV-B) given below.

Formula (IV-A)

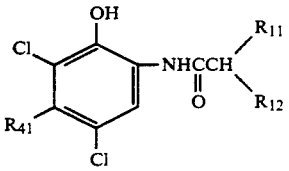

wherein $R_{41}$ represents an ethyl group, a propyl group, or a butyl group, and $R_{11}$ and $R_{12}$ have the same meanings as in formula (I-A).

Formula (IV-B)

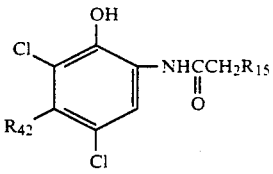

wherein $R_{42}$ represents an ethyl group, a propyl group, or a butyl group, and $R_{15}$ has the same meaning as in formula (I-B).

It is particularly preferable that $R_{41}$ of formula (IV-A) and $R_{42}$ of formula (IV-B) each represent an ethyl group.

Of the magenta couplers of formula (II), preferable ones are those represented by formula (V) given below.

Formula (V):

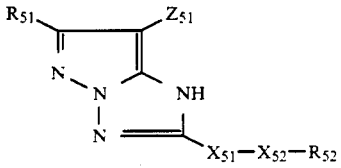

wherein $Z_{51}$ represents a hydrogen atom, a halogen atom, an aryl group, or an arylthio group, $R_{51}$ represents an alkyl group, an alkoxy group, or an aryloxy group, $X_{51}$ represents an alkylene group, an arylene group, or an aralkylene group, $X_{52}$ represents a group $—NHSO_2—$ or a group

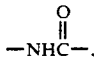

and $R_{52}$ represents an aryl group or an alkyl group.

The alkyl group represented by $R_{51}$ includes an unsubstituted alkyl group (e.g. ethyl, methyl, and t-butyl) and a substituted alkyl group. The substituent of the substituted alkyl group includes an alkoxy group (e.g. methoxy and ethoxy) and an aryl group (e.g. phenyl, p-chlorophenyl, m-tridecaneamidophenyl, and o-methoxyphenyl). The alkoxy group includes an unsubstituted alkoxy group (e.g. methoxy and ethoxy) and a substituted alkoxy group. As the substituent of the substituted alkoxy group, the substituents mentioned for the above alkyl group can be mentioned.

The aryl group of the aryloxy group includes an unsubstituted aryloxy group (e.g. phenoxy) and a substituted aryloxy group. As specific examples of its substituent, an alkyl group (e.g. methyl), an alkoxy group (e.g. methoxy), a halogen atom (e.g. chlorine), and an amido group (e.g. acetamido and methanesulfonamido) can be mentioned.

Particularly preferably $R_{51}$ is an alkyl group having up to 4 carbon atoms, such as a methyl group, an ethyl group, an i-propyl group, and a t butyl group.

As examples of $X_{51}$, an alkylene group (e.g. methylene, ethylene, 1-methylethylene, 2-methylethylene, 2-methylpropylene, 1,1-dimethylethylene, and 2,2-dimethylpropylene), an arylene group (e.g. phenylene, 2-chlorophenylene, and 2-t-butylphenylene), and an aralkylene (e.g. phenethylene) can be mentioned.

The aryl group represented by $R_{52}$ includes a phenyl group and a substituted phenyl group. Its substituent includes, for example, an alkyl group, an alkoxy group, a halogen atom, a sulfonamido group, a sulfamoyl group, an acylamido group, an alkoxycarbonyl group, a hydroxyl group, and a cyano group.

The alkyl group represents an alkyl group having 1 to 36 carbon atoms (e.g. methyl, ethyl, propyl, butyl, octyl, decyl, and pentadecyl), which may be substituted. As the substituent, a substituted or unsubstituted phenoxy group (e.g. 2,4-di-t-amylphenoxy, 2-chloro-4-t-amylphenoxy, 4-t-amylphenoxy, and 2,4-di-t-octylphenoxy) can be mentioned.

Of the yellow couplers represented by formula (III), preferable ones are those represented by formula (VI) given below:

Formula (VI):

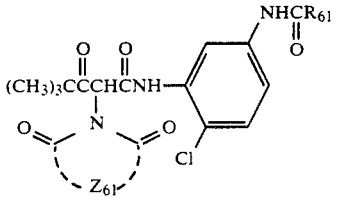

wherein $R_{61}$ represents an unsubstituted alkyl group having 1 to 32 carbon atoms or an aryloxy-substituted alkyl group having 7 to 32 carbon atoms, and $Z_{61}$ represents a group of nonmetal atoms required to complete a 5- or 6-membered ring together with

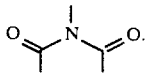

The unsubstituted alkyl group having 1 to 32 carbon atoms represented by $R_{61}$ may be a straight-chain or branched alkyl group, or a primary, secondary, or tertiary alkyl group, and examples thereof include pentadecyl, n-dodecyl, i-stearyl, i-pentadecyl, t-octyl, t-dodecyl, and t-hexadecyl. Of these, secondary and tertiary alkyl groups are particularly preferable.

The aryl group of the aryloxy-substituted alkyl group includes a phenyl group and a substituted phenyl group, and as specific examples of the substituent, a halogen atom (e.g., chlorine), an alkyl group (e.g., t-amyl, t-octyl, methyl, and ethyl), an amido group (e.g., acetamido and methanesulfonamido), a cyano group, a hydroxyl group, and an alkoxy group (e.g., methoxy and ethoxy) can be mentioned.

Specific examples of the couplers of formulae (I-A) to (III) are given below, but the couplers of the present invention are not limited to them.

Coupler of formula (I-A)

(I-A-1)

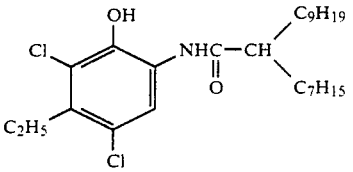

(I-A-2)

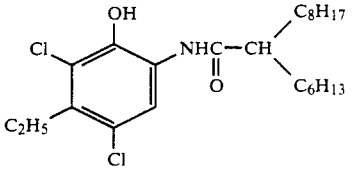

(I-A-3)

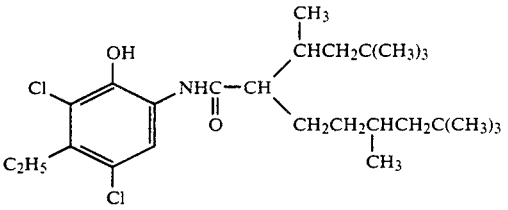

(I-A-4)

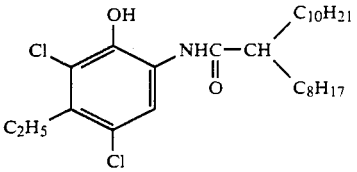

(I-A-5)

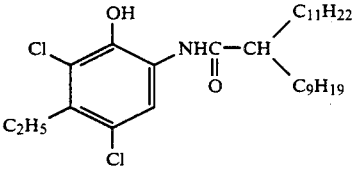

(I-A-6)

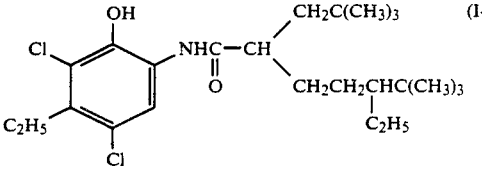

(I-A-7)

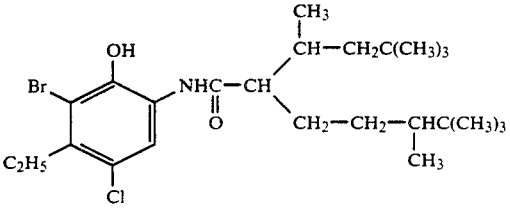

(I-A-8)

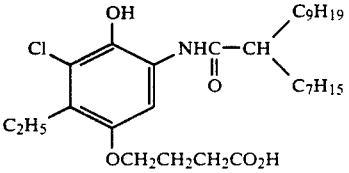

-continued
(I-A-9)
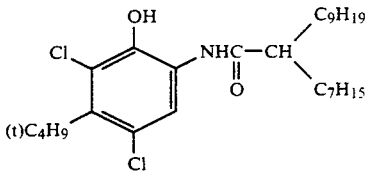
(I-A-10)
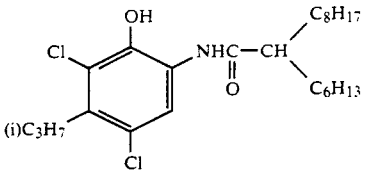
Coupler of formula (I-B)
(I-B-1)
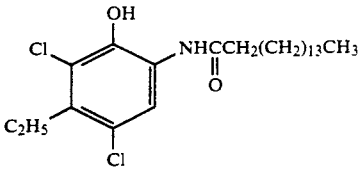
(I-B-2)
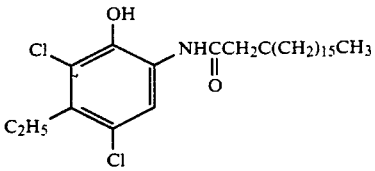
(I-B-3)
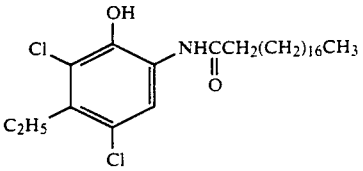
(I-B-4)
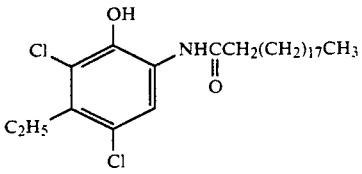
(I-B-5)
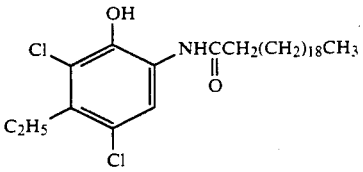
(I-B-6)
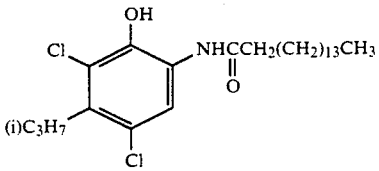
(I-B-7)
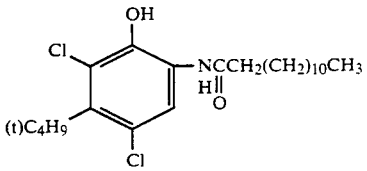
(I-B-8)
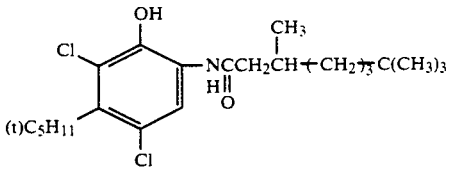
(I-B-9)
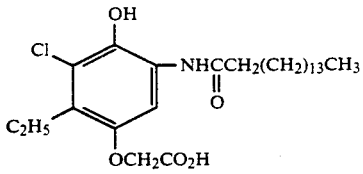
(I-B-10)
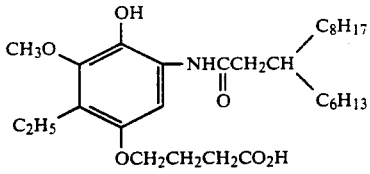
Coupler of formula (II)
(II-1)
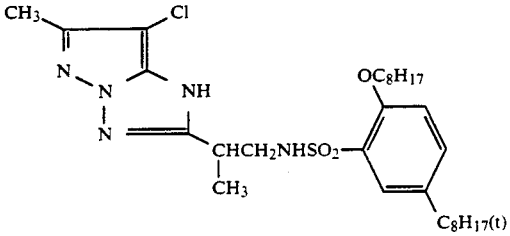

-continued
(II-2)
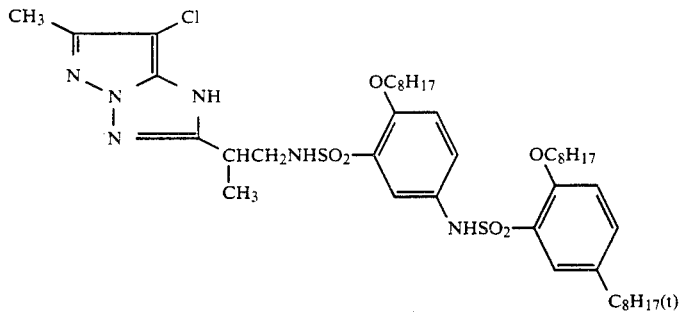
(II-3)
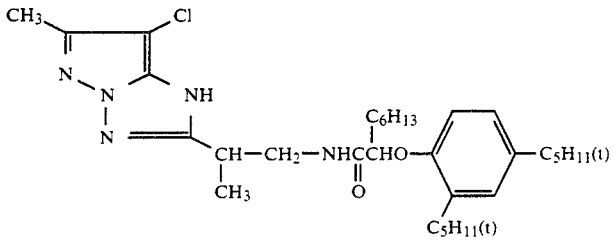
(II-4)
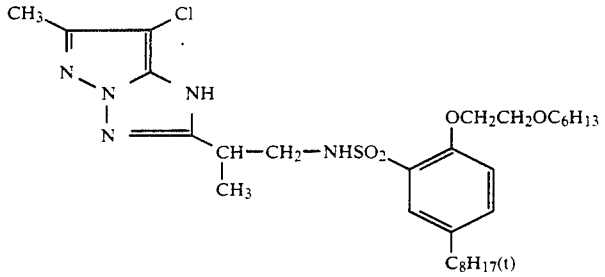
(II-5)
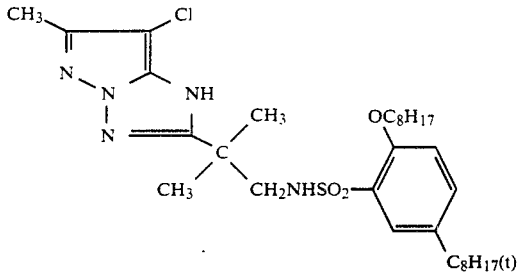
(II-6)
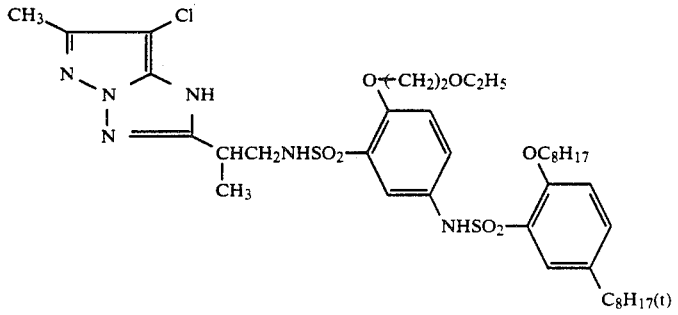

-continued
(II-7)
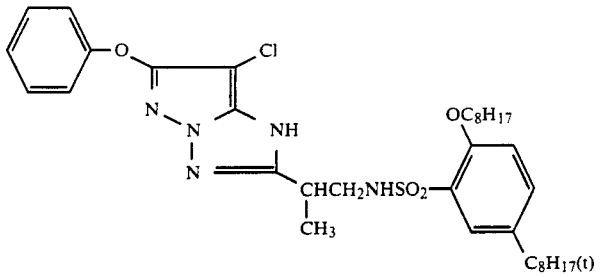
(II-8)
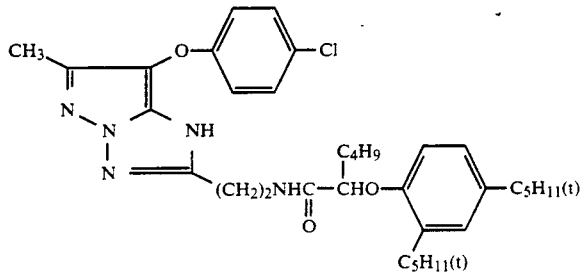
(II-9)
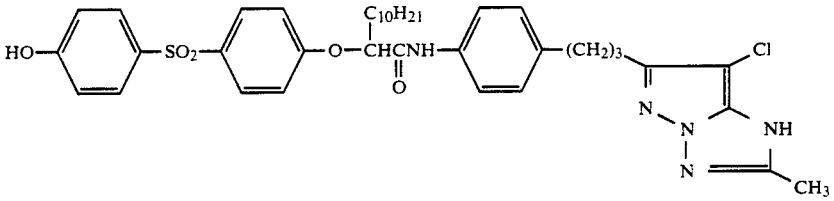
(II-10)
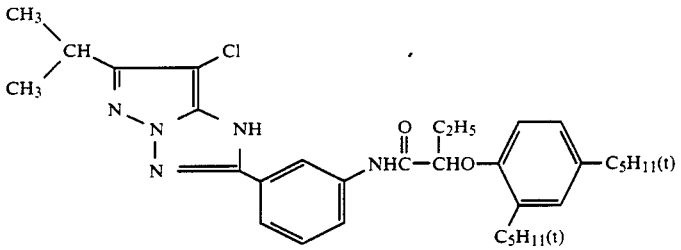
(II-11)
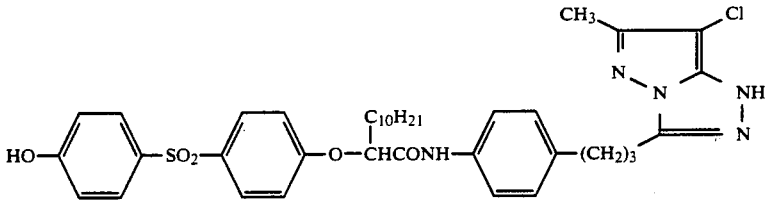
(II-12)
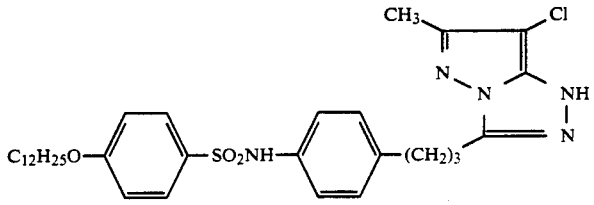

-continued
(II-13)
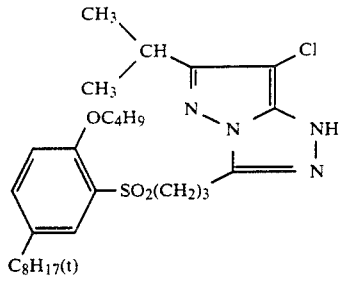
(II-14)
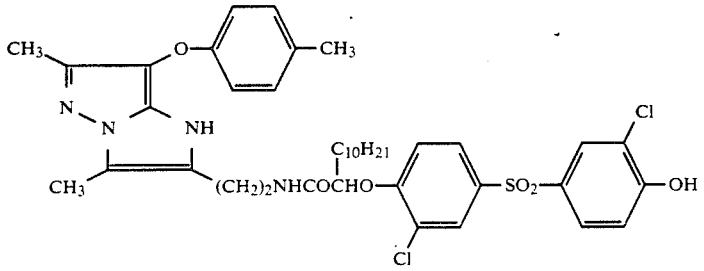
(II-15)
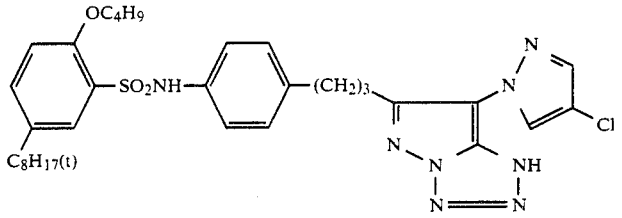
(II-16)
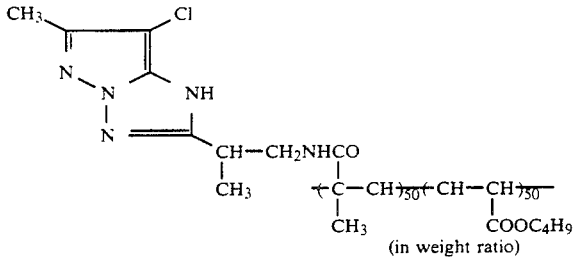
(in weight ratio)
(II-17)
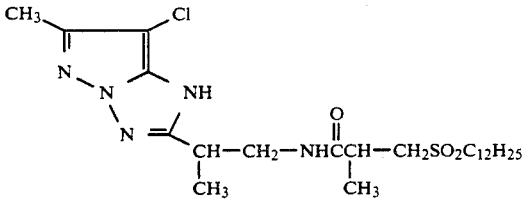
(II-18)
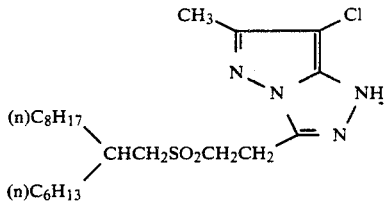
(II-19)
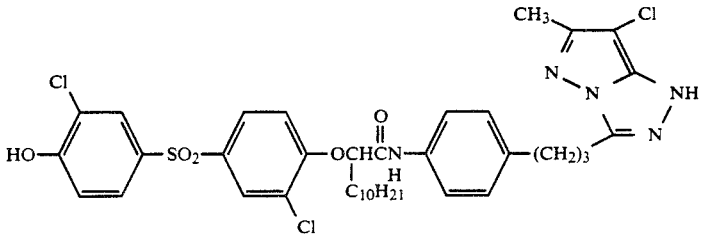

-continued
(II-20)
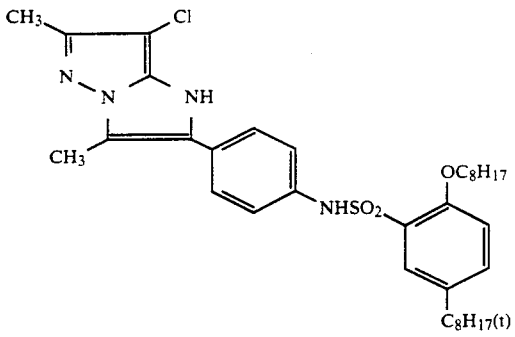
(II-21)
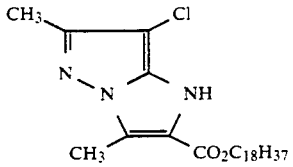
(II-22)
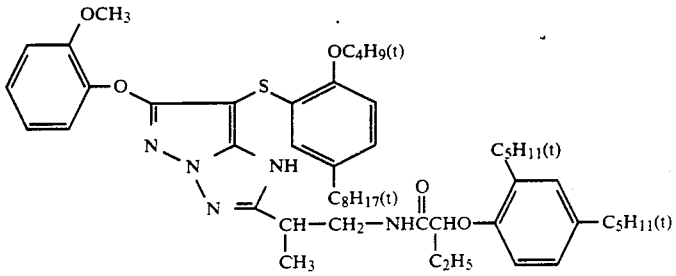
(II-23)
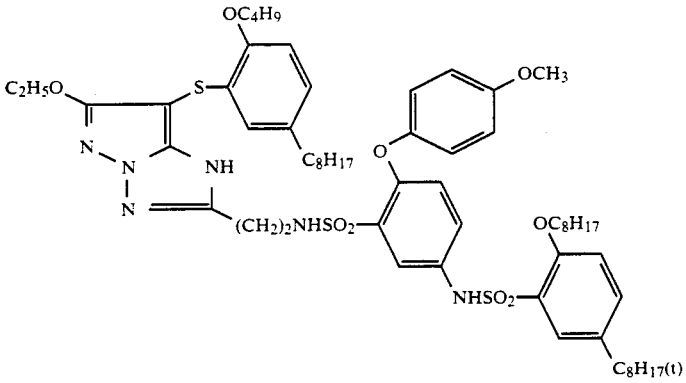
(II-24)
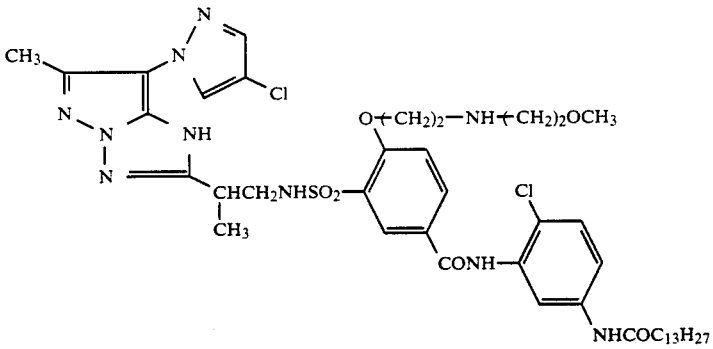
(II-25)
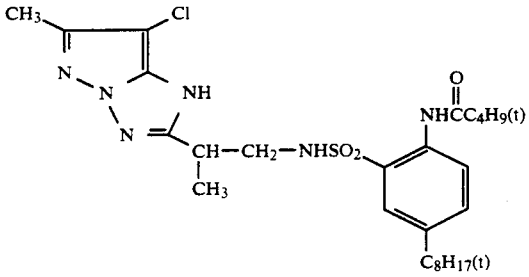
Coupler of formula (III)

-continued
(III-1)
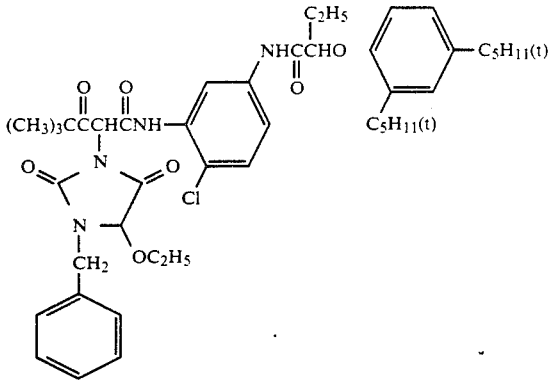
(III-2)
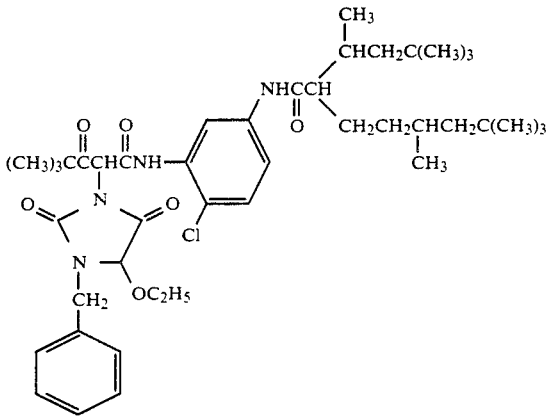
(III-3)
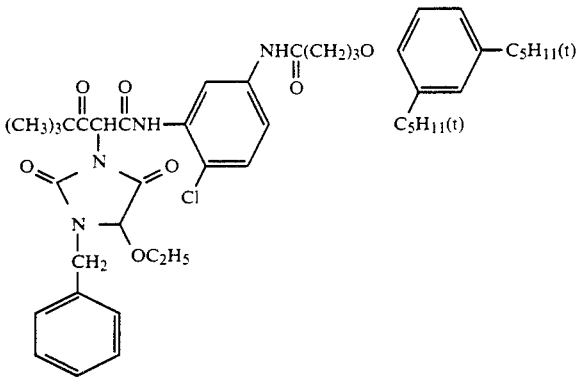
(III-4)
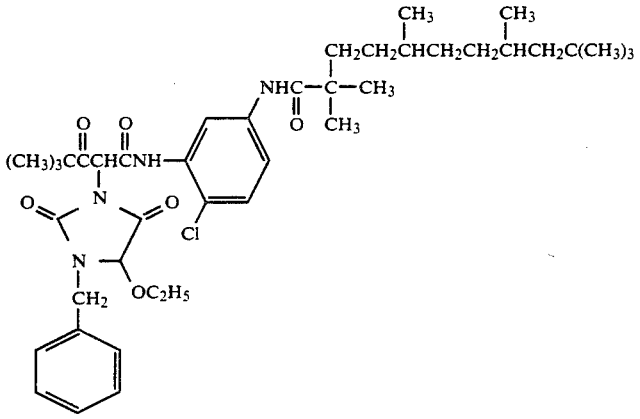

-continued
(III-5)
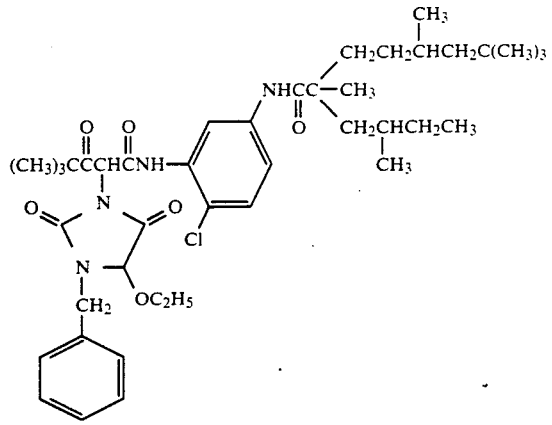
(III-6)
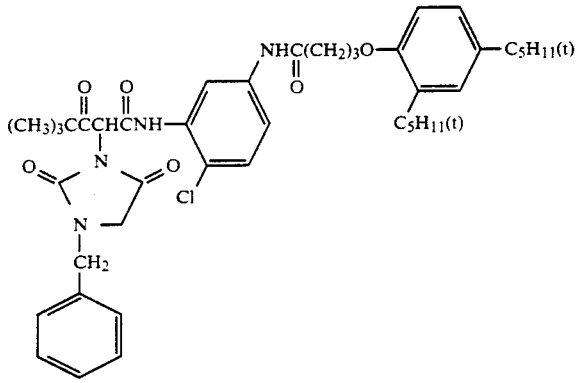
(III-7)
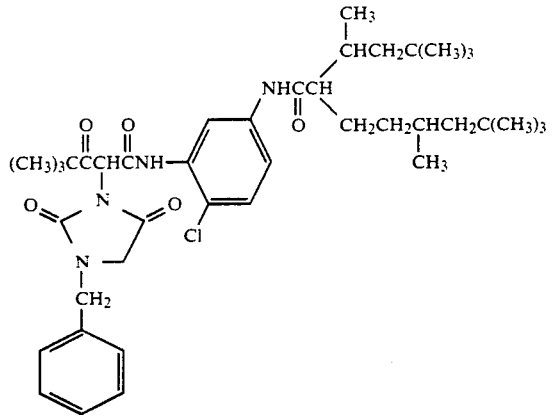
(III-8)
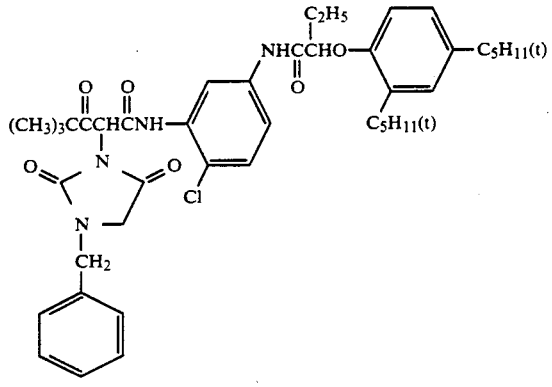

-continued
(III-9)
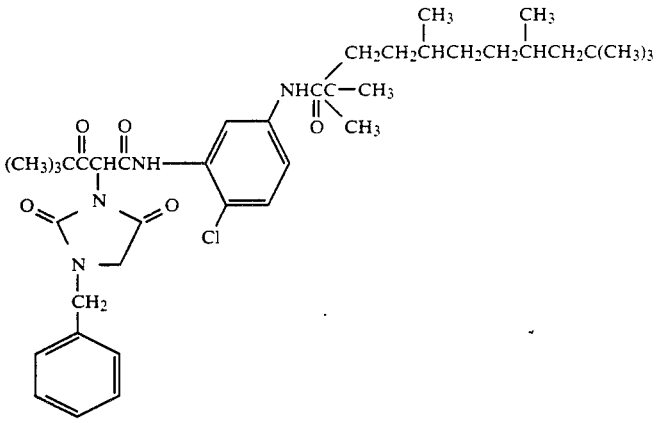
(III-10)
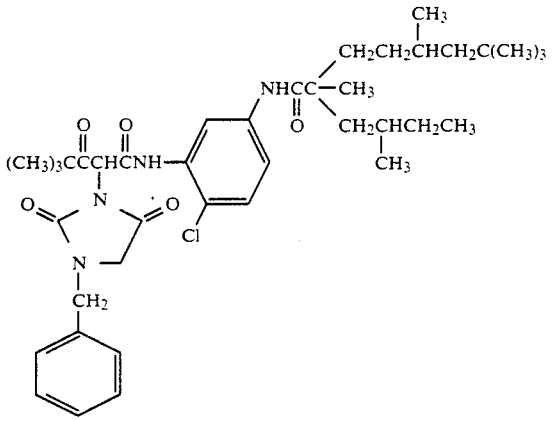
(III-11)
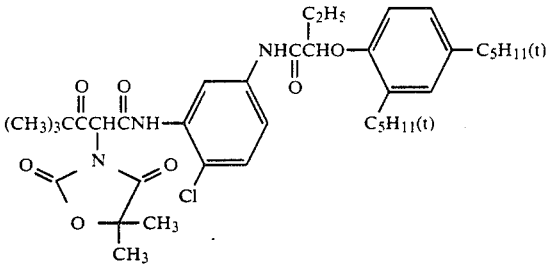
(III-12)
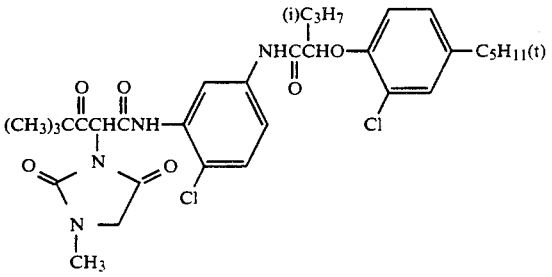

-continued
(III-13)
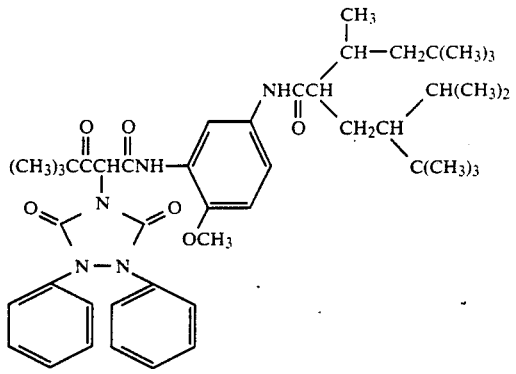
(III-14)
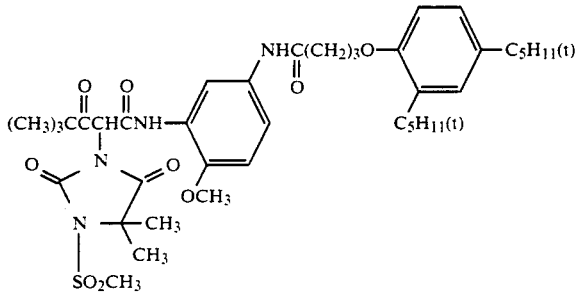
(III-15)
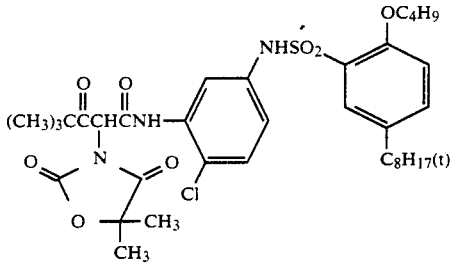
(III-16)
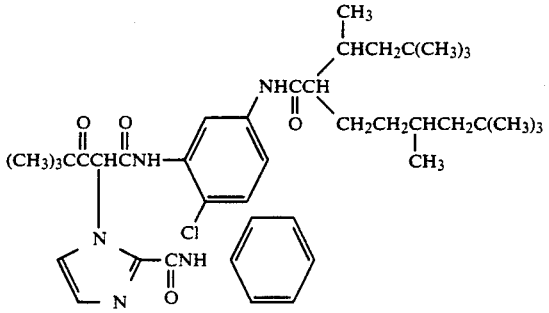

-continued
(III-17)
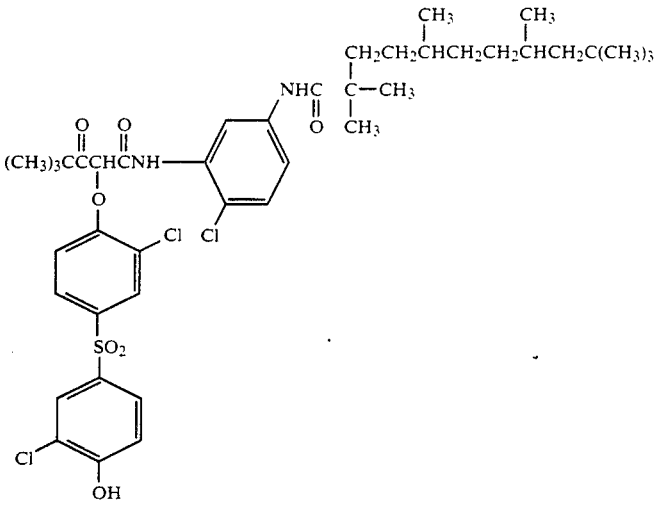
(III-18)
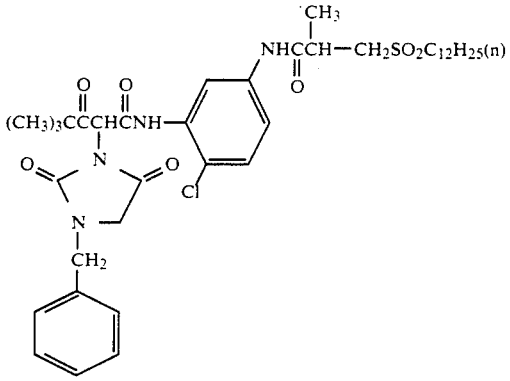
(III-19)
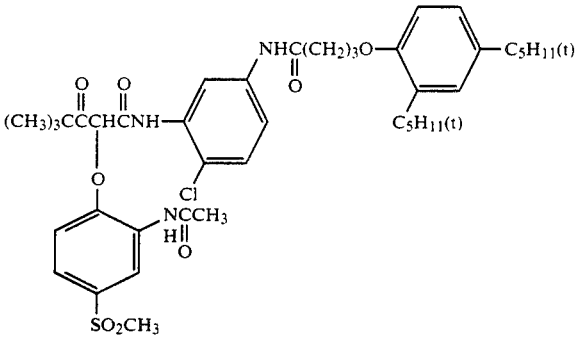
(III-20)
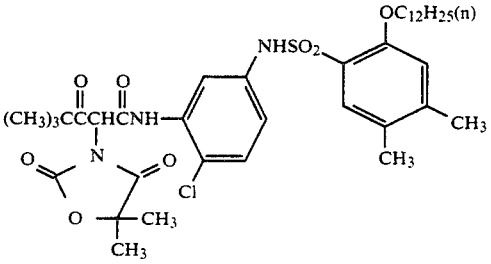

-continued

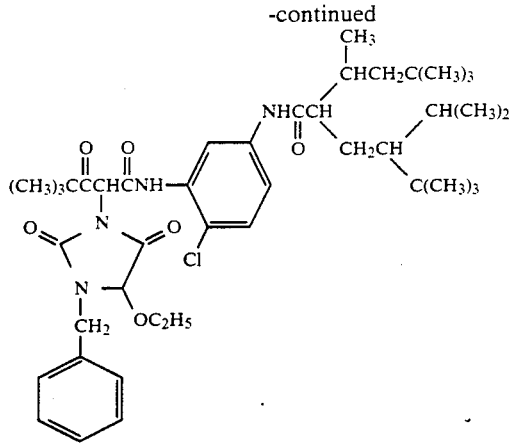

(III-21)

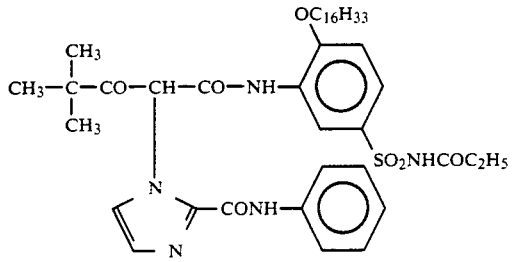

(III-22)

The couplers represented by formulae (I-A), (I-B), (II), and (III) are contained in silver halide emulsion layers constituting photosensitive layers generally in amounts of 0.1 to 1.0 mol, preferably 0.1 to 0.5 mol, respectively, per mol the silver halide. The molar ratio of the couplers represented by formulae (I-A), (I-B), (II), and (III) is generally in the range of 1:0.6–1.4:0.2–1.5:0.6–2.0 in many cases, but a photographic material can be designed wherein the ratio of the above couplers falls outside this range.

The couplers represented by formulae (I-A), and (I-B) used in the present invention can easily be synthesized in the light. for example, of JP-A Nos. 80045/1981, 31935/1984, 121332/1984, 124341/1984, and 205446/1985, JP-B ("JP-B" means examined Japanese patent publication) No. 11572/1974, and U.S. Pat. No. 3,779,763.

The couplers represented by formula (II) used in the present invention can easily be synthesized in the light, for example, of JP-A Nos. 162548/1984, 171956/1984, 33552/1985, and 43659/1985, and U.S. Pat. Nos. 3,061,432, 3,369,897, and 3,725,067.

The couplers represented by formula (III) used in the present invention can easily be synthesized in the light, for example, of JP-A No. 48541/1979, JP-B No. 10739/1983, U.S. Pat. Nos. 4,326,024 and 4,266,019, and *Research Disclosure* Vol. 180, No. 18053.

The color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called colored-couplers capable of forming dyes complementary to light to which the couplers are respectively sensitive, that is, capable of forming yellow dye complementary to blue light, magenta dye complementary to green light, and cyano dye complementary to red light. However, the constitution may be such that the photosensitive layers and the color formed from the couplers do not have the above relationship.

In the present invention, the coating amount of silver halide is 1.5 g/m$^2$ or less, preferably 0.8 g/m$^2$ or less and 0.3 g/m$^2$ or more, in terms of silver. A coating amount of 0.8 g/m$^2$ or less is very preferable in view of rapidness, processing-stability, and storage-stability of image after processing (in particular, restraint of yellow stain). Further, the coating silver amount is preferably 0.3 g/m$^2$ or over, in view of image-density. From these points of view the coating amount of silver halide in terms of silver is more preferably 0.3 to 0.75 g/m2, particularly preferably 0.4 to 0.7 g/m$^2$.

As the silver halide emulsion used in the present invention, one comprising silver chlorobromide or silver chloride and being substantially free from silver iodide can be preferably used. Herein the term "substantially free from silver iodide" means that the silver iodide content is 1 mol% or below, and preferably 0.2 mol% or below. Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

As to the silver halide composition of these silver chlorobromide emulsions, the ratio of silver bromide/-silver chloride can be selected arbitrarily. That is, the ratio is selected from the broad range in accordance with the purpose, but the ratio of silver chloride in a silver chlorobromide is preferably 2 % or over.

Further in the photographic material suitable for a rapid processing of an emulsion of high silver chloride content, a so-called high-silver-chloride emulsion may be used preferably. The content of silver chloride of the high-silver-chloride emulsion is preferably 90 mol% or over, more preferably 95 mol% or over.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol%, and more preferably over 20 mol%. The localized layer may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol% or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol%, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 $\mu$m.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The silver chloromide emulsion used in the present invention can be prepared by methods described, for example, by P. Glafkides, *in Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

As the chemical sensitization method, sulfur sensitization, wherein typically an unstable sulfur compound is added, noble metal sensitization, represented by gold sensitization, or reduction sensitization can be used alone or in combination. As the compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in *Heterocyclic compounds—Cyanine dyes and related compounds* (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

In the silver halide emulsion used in the present invention, various compounds or their precursors can be added for the purpose of stabilizing the photographic performance or preventing fogging that will take place during the process of the production of the photographic material, or during the storage or photographic processing of the photographic material. As specific examples of these compounds, those described in the above-mentioned JP-A No. 215272/1987, pages 39 to 72, are preferably used.

As the emulsion used in the present invention, use is made of a so-called surface latent image type emulsion, wherein a latent image is formed mainly on the grain surface, or of a so-called internal latent image type emulsion, wherein a latent image is formed mainly within the grains.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.). As the high-boiling organic solvent, a high-boiling organic solvent represented by the following formula (A'), (B'), (C'), (D'), or (E') is preferably used.

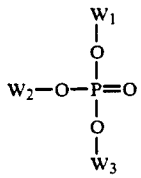

Formula (A')

$W_1—COO—W_2$ Formula (B')

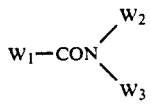

Formula (C')

-continued

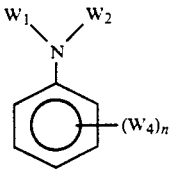

Formula (D')

$W_1—O—W_2$ Formula (E')

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or $S-W_1$, n is an integer of 1 to 5, when n is 2 or over, $W_4$ groups may be the same or different, and in formula (E'), $W_1$ and $W_2$ may together form a condensed ring.

As the high-boiling organic solvent used in the present invention, any compound other than compounds represented by formulae (A') to (E') can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzens, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat.

Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. No. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt% for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidide having a second-order reaction-specific rate $k_2$ (in trioctyl phosphate at 80° C.) in the range of 1.0 l/mol.sec to $1\times10^{-5}$ l/mol.sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

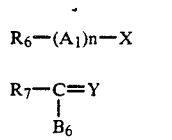

Formula (FI)

Formula (FII)

wherein $R_6$ and $R_7$ each represent an aliphatic group, an aromatic group, or a heterocyclic group, n is 1 or 0, $A_1$ represents a group that will react with an aromatic amine developing agent to form a chemical bond therewith, X represents a group that will react with the aromatic amine developing agent and split off, $B_1$ represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_6$ and X, or Y and $R_7$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

Formula (GI)

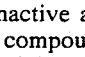

wherein $R_8$ represents an aliphatic group, an aromatic group, or a heterocyclic group, $Z_0$ represents a nucleophilic group or a group that will decompose in the photographic material to release a nucleophilic group. Preferably the compounds represented by formula (GI) are ones wherein $Z_0$ represents a group whose Pearson's nucleophilic $^{n}CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 229145/1987, Japanese Patent Application No.

136724/1988, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type syntheticpaper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

These bases can be optionally selected for use in accordance with the purpose.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 $\mu m \times 6$ $\mu m$, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n}of the unit areas to be subjected is 6 or over. Therefore, the deviation coefficient $s/\overline{R}$ can be obtained by $$\sqrt{\frac{\sum_{i=1}^{n}(Ri-\overline{R})^2}{n-1}} \Big/ \frac{\sum_{i=1}^{n} Ri}{n}.$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

The color developer to be used in the present invention is preferably an aqueous alkali solution whose major component is an aromatic primary amine color-developing agent. As this color-developing agent, amino-phenol compounds are useful, but preferably p-phenylen-diamine compounds are used. Typical examples thereof include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, and 3-methyl-4-amino-N-ethyl-N-$\beta$-methoxyaniline, and there sulfates, hydrochlorides, and p-toluenesulfonates. Two or more of them may be combined to achieve the purpose.

The color developer generally contains, for example, buffers, such as carbonates, borates, or phosphates of alkali metals, development restrainers, such as bromides, iodides, benzimidazoles, benzothiazoles, or mercapto compounds, or antifoggants. If necessary the color developer contains various preservatives, such as hydroxylamine, diethylhydroxylamine, sulfites, hydrazines, such as N,N-biscarboxymethylhydrazine, phehylsemicarbazides, triethanolamine, and catecholsulfonates; and organic solvents, such as ethylene glycol and diethylene glycol; development accelerators, such as benzyl alcohol, polyethylene glycol, quaternary ammonium salts, and amines; dye-forming couplers; competing couplers; auxiliary developers, such as 1-phenyl-3-pyrazolidone; viscosity increasers; and various chelating agents, such as aminopolycarboxylic acids, aminopolyphosphonic acids, alkylphosphonic acids, and phosphonocarboxylic acids, for example ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

If a reversal process is effected, generally black-and-white development is first carried out, and then color development is carried out. In this black-and white developing solution, use is made of a known black-and-white developing agent, including hydroxybenzenes such as hydroquinone, 3-pyrazolidones such as 1-phenyl-3-pyrazolidone, and aminophenols such as N-methyl-p-aminophenol, which may be used alone or in combination.

Generally the pH of this color developer and black-and-white developing solution is 9 to 12. The replenishing amount of these developing solutions is generally 3l or below per square meter of the color photographic material to be processed, though the replenishing amount changes depending on the type of color photographic material, and if the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the solution in processing tank that is in contact with the air. The contact area of the photographic processing solution with the air in the processing tank is represented by the opened surface ratio which is definited as follows:

$$\text{Opened surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

wherein "contact surface area of the processing solution with the air" means a surface area of the processing solution that is not covered by anything such as floating lids or rolls.

The opened surface ratio is preferably 0.1 $cm^{-1}$ or less, more preferably 0.001 to 0.05 $cm^{-1}$.

Methods for reducing the opened surface ratio that can be mentioned include a utilization of movable lids as described in JP-A No. 241342/1987 and a slit-developing process as described in JP A No. 216050/1988, besides a method of providing a shutting materials such as floating lids.

It is preferable to adopt the means for reducing the opened surface ratio not only in a color developing and black-and-white developing process but also in all succeeding processes, such as bleaching, bleach-fixing, fixing, washing, and stabilizing process.

It is also possible to reduce the replenishing amount by using means of suppressing the accumulation of bromide ions in the developer.

Although the processing time of color developing is settled, in generally, between 2 and 5 minutes, the time can be shortened by, for example, processing at high temperature and at high pH, and using a color developer having high concentration of color developing agent.

The photographic emulsion layers are generally subjected to a bleaching process after color development.

The bleaching process can be carried out together with the fixing process (bleach-fixing process), or it can be carried out separately from the fixing process. Further, to quicken the process, bleach-fixing may be carried out after the bleaching process. In accordance with the purpose, the process may be arbitrarily carried out using a bleach fixing bath having two successive tanks, or a fixing process may be carried out before the bleach-fixing process, or a bleaching process. As the bleaching agent, use can be made of, for example, compounds of polyvalent metals, such as iron (III). As typical bleaching agents, use can be made of organic complex salts of iron (III), such as complex salts of aminopolycarboxylic acids, for example ethylenediaminetetraacetic acid, diethylenetriaminetetraacetic acid, cyclohexanediaminetetraacetic acid, methyliminodiacetic acid, 1,3-diaminopropanetetraacetic acid, and glycoletherdiaminetetraacetic acid, citric acid, tartaric acid, and malic acid. Of these, aminopolycarboxylic acid iron (III) complex salts, including ehylenediaminetetraacetic acid iron (III) complex salts are preferable in view of rapid-processing and the prevention of pollution problem. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0, by if it is required to quicken the process, the process can be effected at a low pH.

In the bleaching solution, the bleach-fixing solution, and the bath preceding them a bleach-accelerating agent may be used if necessary. Examples of useful bleach accelerating agents are compounds having a mercapto group or a disulfide linkage, described in U.S. Pat. No. 95630/1978, and *Research Disclosure* No. 17129 (July, 1978); thiazolidine derivatives, described in JP-A No. 140129/1975; thiourea derivatives, described in U.A. Patent No. 3,706,561; iodide salts, described in JP-A No. 16235/1983; polyoxyethylene compounds in West German Patent No. 2,748,460; polyamine compounds, described in JP-B No. 8836/1970; and bromide ions. Of these, compounds having a mercapto group or a disulfide group are preferable in view of higher acceleration effect, and in particular, compounds described in U.A. Patent No. 3,893,858, West German Patent No. 1,290,812, and JP-A No. 95630/1978 are preferable. Compounds described in U.S Pat. No. 4,552,834 are preferable. These bleach-accelerating agents may be added into a photographic material When the color photographic materials for photographing are to be bleach-fixed, these bleach-accelerating agents are particularly effective.

As a fixing agent can be mentioned thiosulfates, thiocyanates, thioether-type compounds, thioureas, and large amounts of iodide salts, although thiosulfate is used usually, and in particular ammonium thiosulfate is widely used. As the preservative for bleach-fix solution sulfite salt, bisulfite salt, or carbonyl-bisulfite adduct is preferably.

It is common for the silver halide color photographic material of the present invention to undergo, after a desilvering process such as fixing or bleach-fix, a washing step and/ or a stabilizing step. The amount of washing water may be set within a wide range depending on the characteristics (e.g., due to the materials used, such as couplers), the application of the photographic material, the washing temperature, the number of washing tanks (the number if steps), the type of replenishing system, including, for example, the counter-current system and the direct flow system and other various conditions. Of these, the relationship between the number of water-washing tanks and the amount of washing water in the multi-stage counter current system can be found according to the method described in *Journal of*

*Society of Motion Picture and Television Engineers,* Vol. 64, pages 248 to 253 (May, 1955).

According to the multi-stage-counter-current system described in the literature mentioned above, although the amount of washing water can be considerably reduced, bacteria propagate with an increase of retention time of the washing water in the tanks, leading to a problem with the resulting suspended matter adhering to the photographic material. In processing the present color photographic material, as a measure to solve this problem the method of reducing calcium and magnesium described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshi Horiguchi in *Bokin Bobai-zai no Kaqaku,* (1986) published by Sankyo-Shuppan, *Biseibutsu no mekkin, Sakkin,Bobaiqijutsu* (1982) edited by Eiseigijutsu-kai, published by Kogyo-Gijutsukai, and in *Bokin Bobaizai Jiten* (1986) edited by Nihon Bokin Bobai-gakkai), can be used.

The pH of the washing water used in processing the present photographic material is 4 to 9, preferably 5 to 8. The washing water temperature and the washing time to be set may vary depending, for example, on the characteristics and the application of the photographic material, and they are generally selected in the range of 15° to 45° C. for sec. to 10 min., and preferably in the range of 25° to 40° C. for 30 sec. to 5 min. Further, the photographic material of the present invention can be processed directly with a stabilizing solution instead of the above washing. In such a stabilizing process, any of the known processes can be used, for example, a multi-step counter-current stabilizing process or its low-replenishing-amount process, described in JP-A Nos. 8543/1982, 14834/1983, and 220345/1985.

In some cases, the above washing process is further followed by stabilizing process, and as an example thereof can be mentioned a stabilizing bath that is used as a final bath for color photographic materials for photography, which contains formalin and a surface-active agent. In this stabilizing bath, each kind of the chelating agents and bactericides may be added.

The over flowed solution due to the replenishing of washing solution and/or stabilizing solution may be reused in other steps, such as a desilvering step.

The silver halide color photographic material of the present invention may contain therein a color-developing agent for the purpose of simplifying and quickening the process. To contain such a color-developing agent, it is preferable to use a precursor for color developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* Nos. 13924, metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolicones. Typical compounds are described in JP-A No. 64339/1981, 144547/1982, and 115438/1983.

The various processing solutions used for the present invention are used at 10° to 50° C. Although generally a temperature of 33° to 38° C. is standard, a higher temperature can be used to accelerate the process to reduce the processing time, or a lower temperature can be used to improve the image quality or the stability of the processing solutions. Also, to save the silver of the photographic material, a process using hydrogen peroxide intensification or cobalt intensification described in West German Patent No. 2,226,770 and U.S. Pat. No. 3,674,499 may be carried out.

Next, the present invention will be described in detail in accordance with the examples, but the invention is not limited to these Examples.

EXAMPLE 1

A multilayer photographic material was prepared by multi-coatings composed of the following layer composition on a two-sided polyethylene laminated paper support. Coating solutions were prepared as follows:

Preparation of the first layer coating solution

To a mixture of 19.1 g of yellow coupler (ExY), 4.4 g of image-dye stabilizer (Cpd-1) and 1.8 g of image-dye stabilizer (Cpd-7), 27.2 ml of ethyl acetate and each 4.1 g of solvents (Solv-3) and (Solv-6) were added and dissolved. The resulting solution was dispersed and emulsified in 185 ml of 10% aqueous gelatin solution containing 8 ml of sodium dodecylbenzenesulfonate. Separately another emulsion was prepared by adding a blue-sensitive sensitizing dye, shown below, to a blend of silver chlorobromide emulsions (mixture in silver molar ratio of 1:3 of two respectively having 0.88 μm and 0.7 μm of average grain size, and 0.08 and 0.10 of deviation coefficient of grain size distribution) in such amounts that the sensitizing dye corresponds $5.0\times10^{-4}$ mol per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-treazine sodium salt was used.

As spectral-sensitizing dyes for the respective layers, the following compounds were used:

Blue-sensitive emulsion layer:

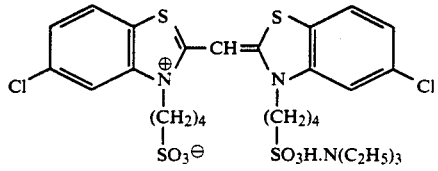

($5.0\times10^{-4}$ mol per mol of silver halide)

-continued

Green-sensitive emulsion layer:

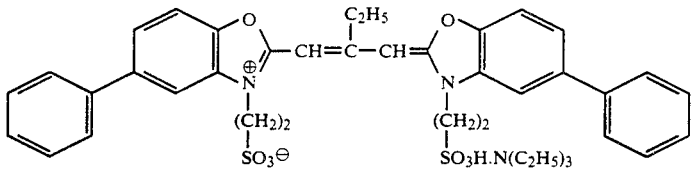

($4.0 \times 10^{-4}$ mol per mol of silver halide)

and

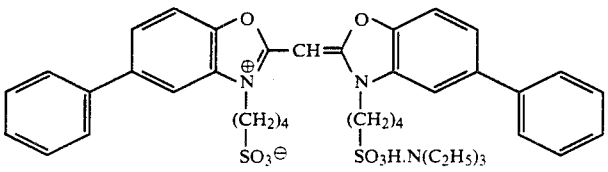

($7.0 \times 10^{-5}$ mol per mol of silver halide)

Red-sensitive emulsion layer:

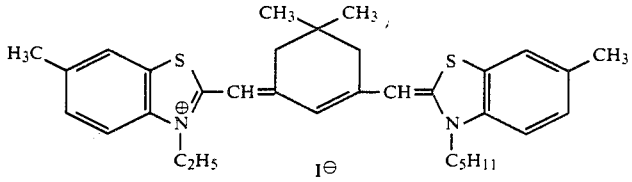

($0.9 \times 10^{-4}$ mol per mol of silver halide)

To the red-sensitive emulsion layer, the following compound was added in an amount of $2.6 \times 10^{-3}$ mol per mol of silver halide:

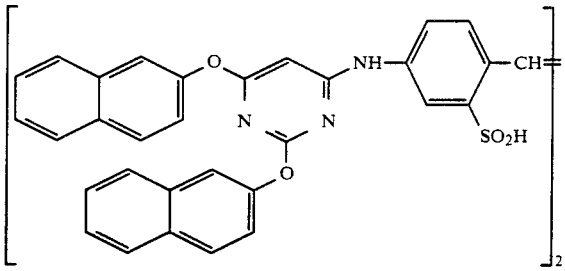

Further, to the blue-sensitive emulsion layer, the green-sensitive layer, and the red-sensitive layer, 1-(5-methylureidophenyl)-5-mercaptotetrazole was added in amounts of $4.0 \times 10^{-6}$ mol, $3.0 \times 10^{-5}$ mol, and $1.0 \times 10^{-5}$ mol per mol of silver halide, respectively, and 2-methyl-5-t-octylhydroquinone was added in amounts of $8 \times 10^{-3}$ mol, $2 \times 10^{-2}$ mol, and $2 \times 10^{-2}$ mol per mol of silver halide, respectively.

Further, to the blue-sensitive emulsion layer and the green-sensitive layer 4-hydroxy-6-methyl-1,3,3*a*,7-tetrazaindene was added in amounts of $1.2 \times 10^{-2}$ mol and $1.1 \times 10^{-2}$ mol per mol of silver halide, respectively.

The following dyes were added to the emulsion layers to prevent irradiation.

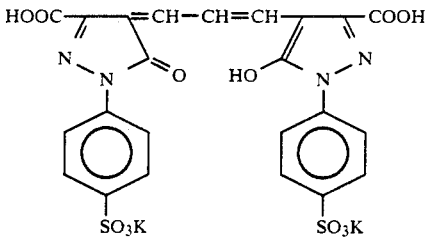

and

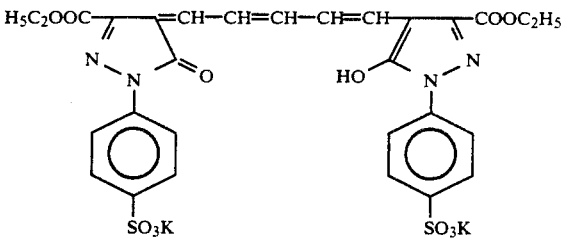

Composition of Layers

The composition of each layer is shown below. The figures represent coating amount (g/m$^2$). The coating amount of each silver halide emulsion is given in terms of silver.

Supporting Base

Paper laminated on both sides with polyethylene (a white pigment, $TiO_2$, and a bluish dye, ultramarine, were included in the first layer side of the polyethylene-laminated film)

| | |
|---|---|
| First Layer (Blue-sensitive emulsion layer): | |
| The above-described silver chlorobromide emulsion (AgBr: 80 mol %) | 0.26 |
| Gelatin | 1.86 |
| Yellow Coupler (ExY) | 0.83 |
| Image-dye stabilizer (Cpd-1) | 0.19 |
| Image-dye stabilizer (Cpd-7) | 0.08 |
| Solvent (Solv-3) | 0.18 |
| Solvent (Solv-6) | 0.18 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:1 (Ag mol ratio) blend of grains having 0.47 μm and 0.36 μm of average grain size, and 0.12 and 0.09 of deviation coefficient of grain size distribution, respectively, each having 90 mol % of AgBr) | 0.16 |
| Gelatin | 1.79 |
| Magenta Coupler (ExM) | 0.22 |
| Image-dye stabilizer (Cpd-3) | 0.20 |
| Image-dye stabilizer (Cpd-8) | 0.03 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.49 μm and 0.34 μm of average grain size, and 0.08 and 0.10 of deviation coefficient of grain size distribution, respectively, each having 90 mol % of AgBr) | 0.23 |
| Gelatin | 1.34 |
| Cyan coupler (ExC-A) | 0.16 |
| Cyan coupler (ExC-B) | 0.15 |
| Image-dye stabilizer (Cpd-6) | 0.17 |
| Image-dye stabilizer (Cpd-7) | 0.40 |
| Solvent (Solv-6) | 0.20 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(Cpd-1) Image-dye stabilizer

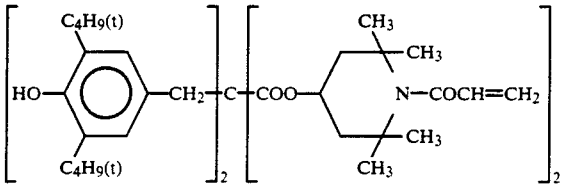

(Cpd-3) Image-dye stabilizer

-continued

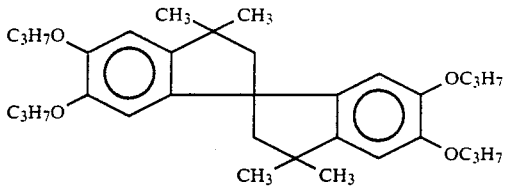

(Cpd-4) Image-dye stabilizer

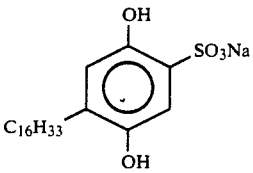

(Cpd-5) Color-mix inhibitor

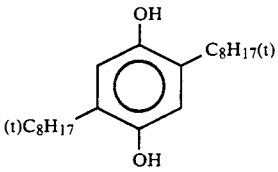

(Cpd-6) Image-dye stabilizer

Mixture (2:4:4 in weight ratio) of

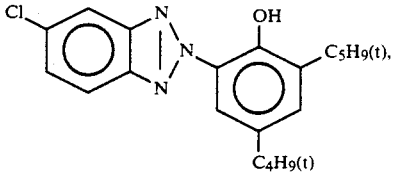

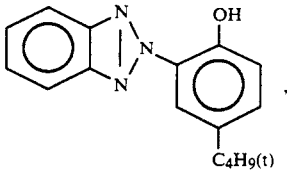

and

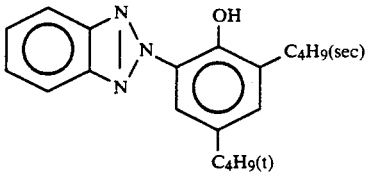

(Cpd-7) Image-dye stabilizer

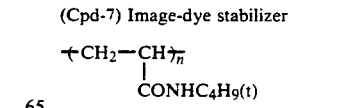

Average molecular weight: 80,000

(Cpd-8) Image-dye stabilizer

-continued

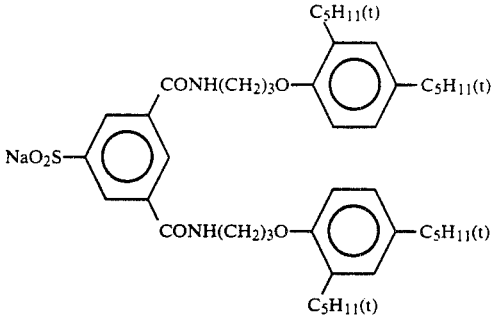

(Cpd-9) Image-dye stabilizer

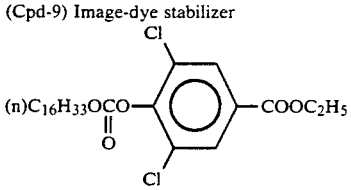

(UV-1) Ultraviolet ray absorber
Mixture (4:2:4 in weight ratio) of

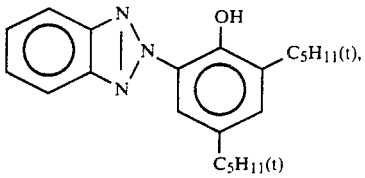

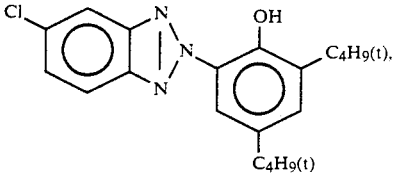

and

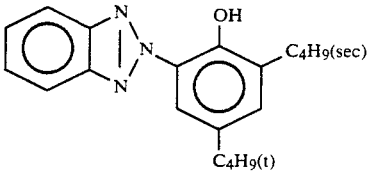

(Solv-1) Solvent

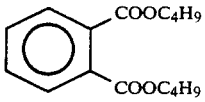

(Solv-2) Solvent
Mixture (2:1 in volume ratio) of

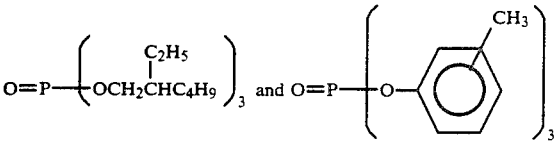

-continued (Solv-3) Solvent
$O{=}P{+}O{-}C_9H_{19}(iso))_3$ (Solv-4) Solvent

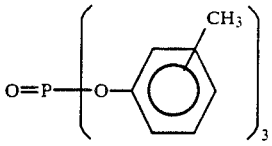

(Solv-5) Solvent
$COOC_8H_{17}$
|
$(CH_2)_8$
|
$COOC_8H_{17}$ (Solv-6) Solvent
$C_8H_{17}CHCH(CH_2)_7COOC_8H_{17}$
$\backslash\ /$
O (ExY) Yellow coupler
Exemplified coupler (III-1)
(ExM) Magenta coupler
Exemplified coupler (II-3)
(ExC-A) Cyan coupler
Exemplified coupler (I-A-1)
(ExC-B) Cyan coupler
Exemplified coupler (I-B-1)

The thus-prepared photographic paper was designated as Sample 101.

Samples 102 to 115 were prepared in the same manner as Sample 101, except that the yellow coupler in the first layer, the magenta coupler in the third layer, and the cyan coupler in the fifth layer were changed to other couplers in equimolar amounts as shown in Table 1.

Couplers shown below were used for comparison.

CR-1

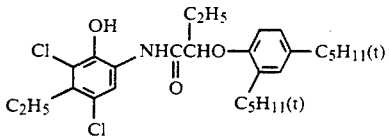

(Coupler described in U.S. Pat. No. 4,748,100)

CR-2

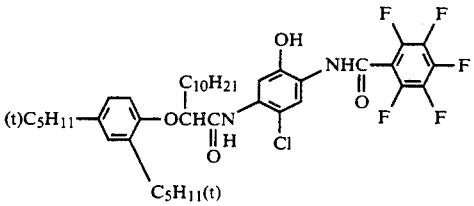

(Coupler described in JP-A No. 57238/1984)

TABLE 1

| Sample | Yellow Coupler in 1st Layer | Magenta Coupler in 3rd Layer | Cyan Coupler in 5th Layer | Remarks |
|---|---|---|---|---|
| 101 | Exemplified Coupler (III-1) | Exemplified Coupler (II-3) | Exemplified Coupler (I-A-1)/(I-B-1) (1:1)* | This Invention |
| 102 | Exemplified Coupler (III-1) | Exemplified Coupler (II-3) | Exemplified Coupler (I-A-1)/(I-B-1) (1.5:1) | This Invention |

TABLE 1-continued

| Sample | Yellow Coupler in 1st Layer | Magenta Coupler in 3rd Layer | Cyan Coupler in 5th Layer | Remarks |
|---|---|---|---|---|
| 103 | Exemplified Coupler (III-1) | Exemplified Coupler (II-2) | Exemplified Coupler (I-A-1)/(I-B-2) (1:1) | This Invention |
| 104 | Exemplified Coupler (III-1) | Exemplified Coupler (II-2) | Exemplified Coupler (I-A-1)/(I-B-3) (1:1) | This Invention |
| 105 | Exemplified Coupler (III-2) | Exemplified Coupler (II-3) | Exemplified Coupler (I-A-2)/(I-B-1) (1:1) | This Invention |
| 106 | Exemplified Coupler (III-3) | Exemplified Coupler (II-1) | Exemplified Coupler (I-A-2)/(I-B-2) (1:1) | This Invention |
| 107 | Exemplified Coupler (III-3) | Exemplified Coupler (II-6) | Exemplified Coupler (I-A-2)/(I-B-3) (1:1) | This Invention |
| 108 | Exemplified Coupler (III-11) | Exemplified Coupler (II-1) | Exemplified Coupler (I-A-3)/(I-B-1) (1:1) | This Invention |
| 109 | Exemplified Coupler (III-15) | Exemplified Coupler (II-3) | Exemplified Coupler (I-A-1) | Comparative Example |
| 110 | Exemplified Coupler (III-1) | Exemplified Coupler (II-3) | Exemplified Coupler (I-B-1) | Comparative Example |
| 111 | Exemplified Coupler (III-1) | Exemplified Coupler (II-3) | Exemplified Coupler (I-B-2) | Comparative Example |
| 112 | Exemplified Coupler (III-1) | Exemplified Coupler (II-3) | Comparative Coupler CR-1 | Comparative Example |
| 113 | Exemplified Coupler (III-1) | Exemplified Coupler (II-3) | Comparative Coupler CR-2 | Comparative Example |
| 114 | Exemplified Coupler (III-1) | Exemplified Coupler (II-3) | Comparative Coupler (CR-1)/(CR-2) (1:1) | Comparative Example |
| 115 | Exemplified Coupler (III-1) | Exemplified Coupler (II-3) | Exemplified Coupler (I-A-1) | Comparative Example |

Note:
*Ratio in molar ratio

The thus-prepared photographic materials were subjected to exposure to light through an optical wedge and to the following processing steps.

| Processing step | Temperature | Time |
|---|---|---|
| Color Development | 38° C. | 1 min. 40 sec. |
| Bleach-fixing | 35° C. | 1 min. 00 sec. |
| Rinsing ① | 33–35° C. | 20 sec. |
| Rinsing ② | 33–35° C. | 20 sec. |
| Rinsing ③ | 33–35° C. | 20 sec. |
| Drying | 70–80° C. | 50 sec. |

Note:
Rinsing steps were carried out in a 3-tank countercurrent flow mode from the tank of rinsing ③ towards the tank of rinsing ①.

The composition of the respective processing solution were as follows:

| | Tank solution |
|---|---|
| Color developer | |
| Water | 800 ml |
| Diethylenetriaminepentaacetic acid | 1.0 g |
| Nitrotriacetic acid | 2.0 g |
| 1-Hydroxyethylidene-1,1-diphosphonic acid | 2.0 g |
| Benzyl alcohol | 16 ml |
| Diethylene glycol | 10 ml |
| Sodium sulfite | 2.0 g |
| Potassium bromide | 0.5 g |
| Potassium carbonate | 30 g |
| N-Ethyl-N-(β-methanesulfonamidoethyl)-3-methyl-4-aminoaniline sulfate | 5.5 g |
| Hydroxylamine sulfate | 2.0 g |
| Fluorescent brightening agent (WHITEX4, made by Sumitomo Chem. Ind.) | 1.5 g |
| Water to make | 1000 ml |

-continued

| | Tank solution |
|---|---|
| pH (25° C.) | 10.20 |
| Bleach-fixing solution | |
| Water | 400 ml |
| Ammonium thiosulfate (700 g/l) | 80 ml |
| Ammonium sulfite | 24 g |
| Iron (III) ammonium ethylenediaminetetraacetate dihydrate | 30 g |
| Disodium ethylenediaminetetraacetate | 5 g |
| Water to make | 1000 ml |
| pH (25° C.) | 6.50 |
| Water washing solution | |
| Ion-exchanged water (each content of calcium and magnesium was 3 ppm or below) | |

Samples that have color image formed by the above-described process were subjected to test for determining the maximum densities of each color, the density of cyan stain at an unexposed part, and the preservation properties to light and to storage under dark and hot condition as shown (a) and (b) below.

(a) Preservation property to light

Irradiation of light of $8.0\times10^{-4}$ lux for 10 days by using Xenon fade-o-meter (b) Preservation property to storage in dark and hot Storage at 80° C., 70% RH for 3 weeks The preservation property of dye-image was designated by a percentage of the density after test (D) to the initial density [$(D_0)=1.0$]. And the density of cyan stain was designated by the blue-density after being allowed to stand for 1 week at 60° C. and 70% RH. Results are shown in Table 2.

TABLE 2

| Sample | Cyan Stain Density | Maximum Density | | | Preservation Property | | | | | | Remarks |
|---|---|---|---|---|---|---|---|---|---|---|---|
| | | | | | Light | | | Dark & Hot | | | |
| | | Y | M | C | Y | M | C | Y | M | C | |
| 101 | 0.08 | 2.43 | 2.54 | 2.53 | 88 | 90 | 91 | 94 | 96 | 94 | This Invention |
| 102 | 0.08 | 2.41 | 2.53 | 2.54 | 90 | 91 | 92 | 92 | 95 | 94 | This Invention |
| 103 | 0.08 | 2.42 | 2.54 | 2.53 | 88 | 89 | 90 | 94 | 96 | 93 | This Invention |
| 104 | 0.08 | 2.42 | 2.52 | 2.54 | 86 | 88 | 90 | 92 | 96 | 94 | This Invention |
| 105 | 0.08 | 2.42 | 2.50 | 2.53 | 90 | 91 | 90 | 90 | 95 | 95 | This Invention |
| 106 | 0.06 | 2.43 | 2.51 | 2.52 | 88 | 89 | 90 | 90 | 95 | 94 | This Invention |
| 107 | 0.06 | 2.39 | 2.50 | 2.53 | 90 | 89 | 90 | 92 | 96 | 96 | This Invention |
| 108 | 0.08 | 2.38 | 2.50 | 2.52 | 86 | 88 | 90 | 94 | 96 | 96 | This Invention |
| 109 | 0.08 | 2.42 | 2.53 | 2.44 | 90 | 90 | 86 | 92 | 95 | 93 | Comparative Example |
| 110 | 0.16 | 2.40 | 2.53 | 2.53 | 88 | 90 | 90 | 94 | 94 | 82 | Comparative Example |
| 111 | 0.16 | 2.41 | 2.51 | 2.53 | 90 | 88 | 90 | 96 | 94 | 80 | Comparative Example |
| 112 | 0.12 | 2.42 | 2.50 | 2.47 | 88 | 90 | 72 | 94 | 93 | 96 | Comparative Example |
| 113 | 0.12 | 2.42 | 2.49 | 2.34 | 89 | 88 | 65 | 90 | 94 | 98 | Comparative Example |

TABLE 2-continued

| Sample | Cyan Stain Density | Maximum Density Y | M | C | Preservation Property Light Y | M | C | Dark & Hot Y | M | C | Remarks |
|---|---|---|---|---|---|---|---|---|---|---|---|
| 114 | 0.10 | 2.38 | 2.50 | 2.48 | 86 | 89 | 76 | 92 | 96 | 90 | Comparative Example |
| 115 | 0.08 | 2.40 | 2.53 | 2.43 | 90 | 90 | 86 | 90 | 95 | 93 | Comparative Example |

As is apparent from the results of Table 2, by comparison between samples 101 to 108 of the present invention and samples 109 to 115 that used comparative couplers, it can be understood that the samples of the present invention exhibited superior property in view of good color-balance of image, less cyan stain, and good preservation properties to light and storage under dark and hot conditions.

EXAMPLE 2

A multilayer photographic material was prepared by multi-coatings composed of the following layer composition on a two-side polyethylene laminated paper support. Coating solutions were prepared as follows:

Preparation of the first layer coating solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3:7 (silver mol ratio) blend of grains having 0.88 μm and 0.7 μm of average grain size, and 0.08 and 0.10 of deviation coefficient of grain size distribution, respectively, each in which 0.2 mol% of silver bromide was located at the surface of grains) in such amounts that each dye corresponds $2.0\times10^{-4}$ mol to the large size emulsion and $2.5\times10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As gelatin hardener for the respective layers, 1-hydroxy-3,5-dichloro-s-treazine sodium salt was used.

As spectral-sensitizing dyes for the respective layers, the following compounds were used:

Blue-sensitive emulsion layer:

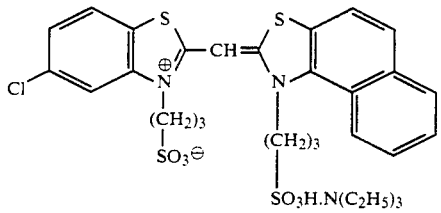

and

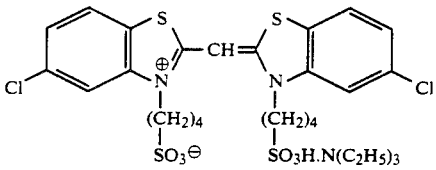

(each $2.0\times10^{-4}$ mol to the large size emulsion and $2.5\times10^{-4}$ mol to the small size emulsion, per mol of silver halide.)

Green-sensitive emulsion layer:

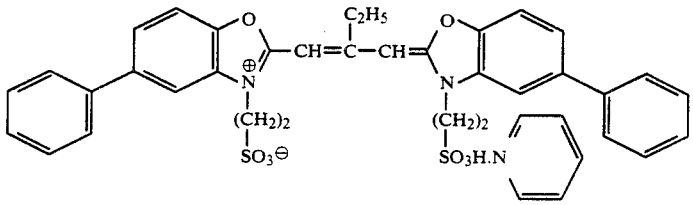

($4.0\times10^{-4}$ mol to the large size emulsion and $5.6\times10^{-4}$ mol to the small size emulsion, per mol of silver halide)

and

-continued

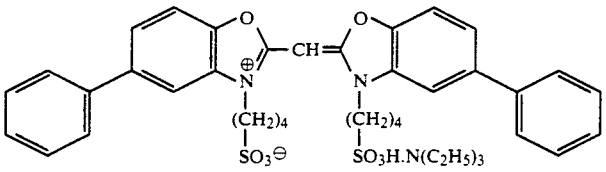

($7.0 \times 10^{-5}$ mol to the large size emulsion and $1.0 \times 10^{-5}$ mol to the small size emulsion, per mol of silver halide)

Red-sensitive emulsion layer:

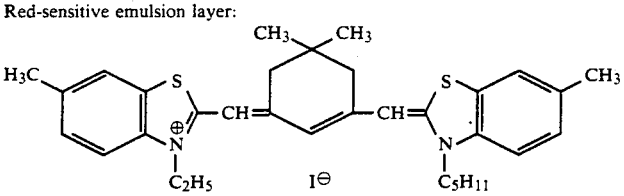

($0.9 \times 10^{-4}$ mol to the large size emulsion and $1.1 \times 10^{-4}$ mol to the small size emulsion, per mol of silver halide)

To the red-sensitive emulsion layer, the following compound was added in an amount of $2.6 \times 10^{-3}$ mol per mol of silver halide:

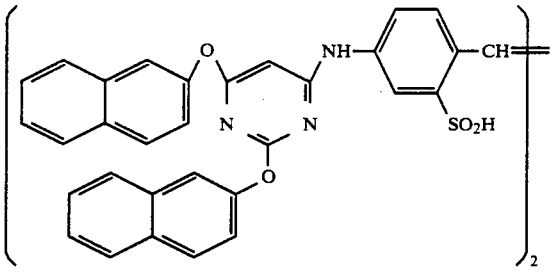

Further, 1-(5-methylureidophenyl)-5-mercaptotetrazole was added to the blue-sensitive emulsion layer, the green-sensitive emulsion layer, and the red-sensitive emulsion layer in amount of $8.5 \times 10^{-5}$ mol, $7.0 \times 10^{-4}$ mol, and $2.5 \times 10^{-4}$ mol, per mol of silver halide, respectively.

The dyes shown below were added to the emulsion layers for prevention of irradiation.

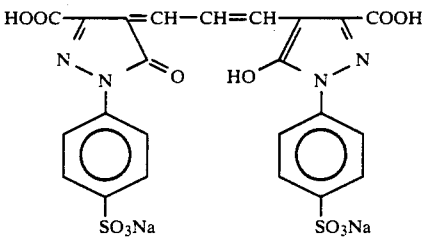

and

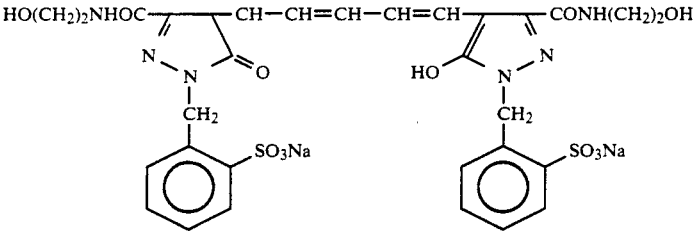

Composition of Layers

The composition of each layer is shown below. The figures represent coating amount (g/m$^2$). The coating amount of each silver halide emulsion is given in terms of silver.

Supporting Base

Paper laminated on both sides with polyethylene (a white pigment, $TiO_2$, and a bluish dye, ultramarine, were included in the first layer side of the polyethylene-laminated film)

| | |
|---|---|
| First Layer (Blue-sensitive emulsion layer): | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image dye stabilizer (Cpd-7) | 0.06 |
| Second Layer (Color-mix preventing layer): | |

-continued

| | |
|---|---|
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 1.24 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |

-continued

| | |
|---|---|
| Silver chlorobromide emulsions (cubic grains, 1:4 (Ag mol ratio) blend of grains having 0.58 μm and 0.45 μm of average grain size, and 0.09 and 0.11 of deviation coefficient of grain size distribution, respectively, each in which 0.6 mol % of AgBr was located at the surface of grains) | 0.23 |
| Gelatin | 1.34 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of

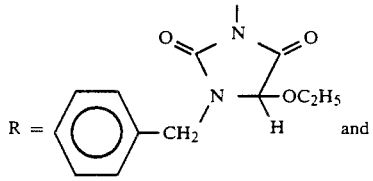

(Exemplified coupler III-1)

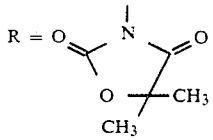

(Exemplified coupler III-11)

of the following formula

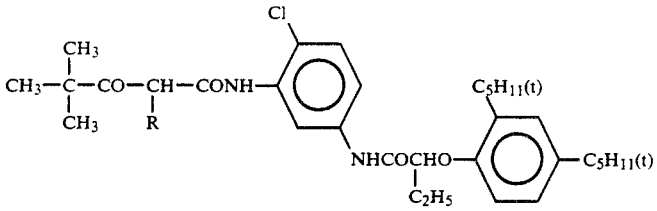

(ExM) Magenta coupler

Mixture (1:1 in molar ratio) of

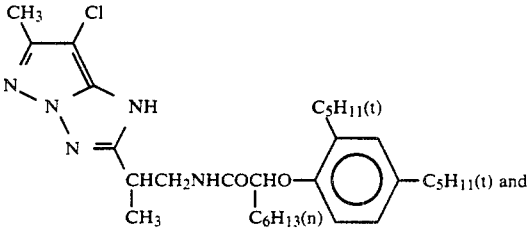

(Exemplified coupler II-3)

-continued
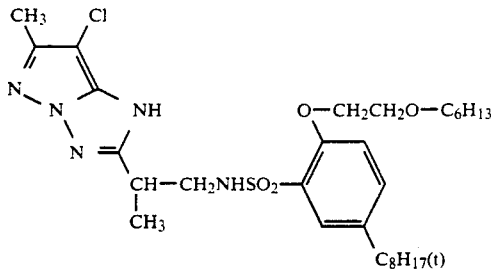
(Exemplified coupler II-4)
(ExC) Cyan coupler
Mixture (2:4:4 in weight ratio) of
R = $C_2H_5$ and $C_4H_9$ of
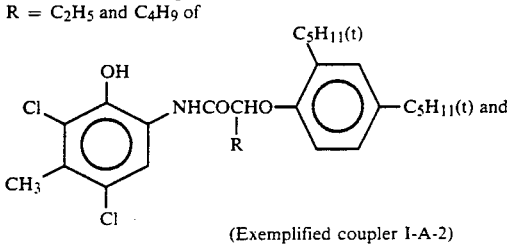
(Exemplified coupler I-A-2)
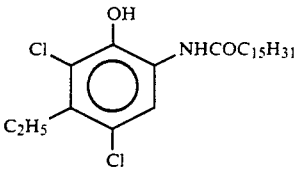
(Exemplified coupler I-B-1)
(Cpd-1) Image-dye stabilizer
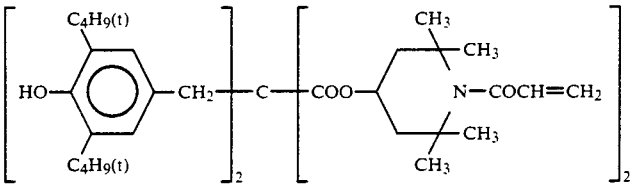
(Cpd-2) Image-dye stabilizer
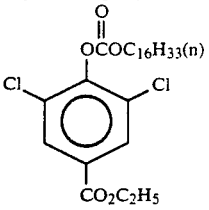
(Cpd-3) Image-dye stabilizer
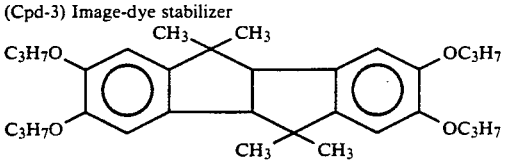
(Cpd-4) Image-dye stabilizer
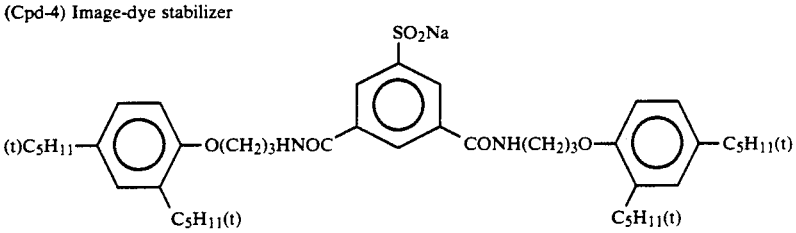

-continued
(Cpd-5) Color-mix inhibitor
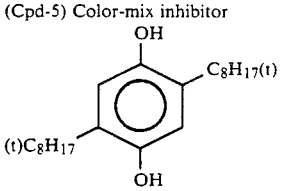
(Cpd-6) Image-dye stabilizer
Mixture (2:4:4 in weight ratio) of
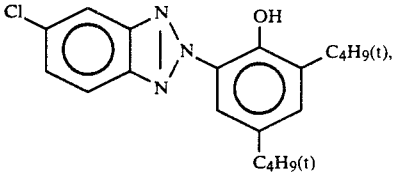
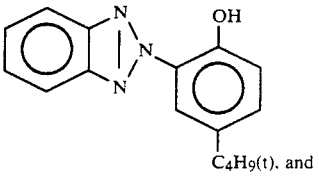
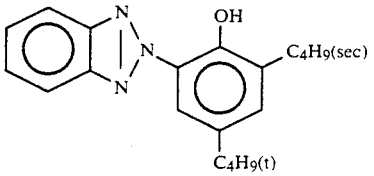
(Cpd-7) Image-dye stabilizer
$$\left(CH_2-\underset{\substack{|\\ CONHC_4H_9(t)}}{CH}\right)_n$$
Average molecular weight: 60,000
(Cpd-8) Image-dye stabilizer
Mixture (1:1 in weight ratio) of
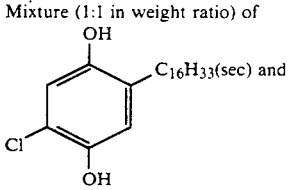
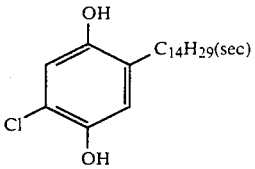
(Cpd-9) Image-dye stabilizer
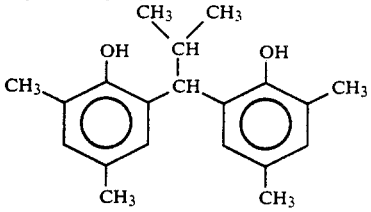
(UV-1) Ultraviolet ray absorber
Mixture (4:2:4 in weight ratio) of
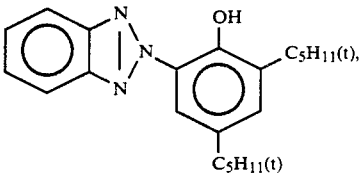

-continued

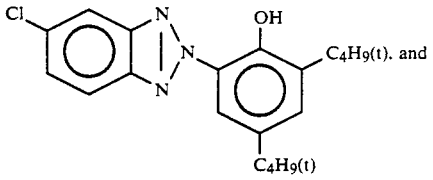

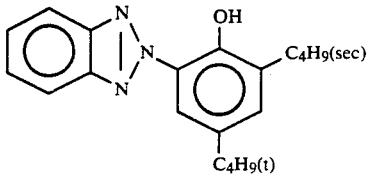

(Solv-1) Solvent

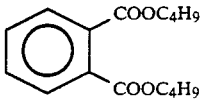

(Solv-2) Solvent
Mixture (2:1 in volume ratio) of

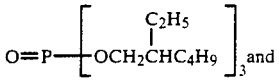

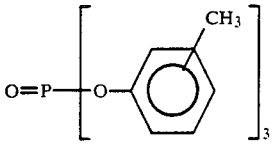

(Solv-4) Solvent

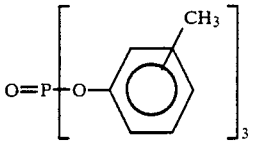

(Solv-5) Solvent

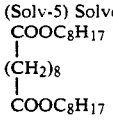

(Solv-6) Solvent

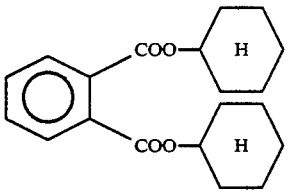

The thus-prepared photographic paper was designated Sample 201.

Samples 202 to 215 were prepared in the same manner as Sample 201, except that the yellow coupler in the first layer, the magenta coupler in the third layer, and the cyan coupler in the fifth layer were changed to other couplers in equimolar amounts as shown in Table 3.

Couplers used for comparison were the same as in example 1.

TABLE 3

| Sample | Yellow Coupler in the 1st Layer | Magenta Coupler in the 3rd Layer | Cyan Coupler in the 5th Layer | Remarks |
|---|---|---|---|---|
| 201 | Exemplified coupler (III-1)/(III-11) (1:1)* | Exemplified coupler (II-3)/(II-4) (1:1)* | Exemplified Coupler (I-A-2)/(I-B-1) (1:1)* | This Invention |

TABLE 3-continued

| Sample | Yellow Coupler in the 1st Layer | Magenta Coupler in the 3rd Layer | Cyan Coupler in the 5th Layer | Remarks |
|---|---|---|---|---|
| 202 | Exemplified coupler (III-1) | Exemplified coupler (II-3) | Exemplified Coupler (I-A-2)/(I-B-1) (1.5:1) | This Invention |
| 203 | Exemplified coupler (III-1) | Exemplified coupler (II-2) | Exemplified Coupler (I-A-1)/(I-B-1) (1:1) | This Invention |
| 204 | Exemplified coupler (III-1) | Exemplified coupler (II-2) | Exemplified Coupler (I-A-1)/(I-B-2) (1:1) | This Invention |
| 205 | Exemplified coupler (III-2) | Exemplified coupler (II-3) | Exemplified Coupler (I-A-1)/(I-B-3) (1:1) | This Invention |
| 206 | Exemplified coupler (III-3) | Exemplified coupler (II-1) | Exemplified Coupler (I-A-2)/(I-B-2) (1:1) | This Invention |
| 207 | Exemplified coupler (III-3) | Exemplified coupler (II-6) | Exemplified Coupler (I-A-2)/(I-B-3) (1:1) | This Invention |
| 208 | Exemplified coupler (III-11) | Exemplified coupler (II-1) | Exemplified Coupler (I-A-3)/(I-B-1) (1:1) | This Invention |
| 209 | Exemplified coupler (III-15) | Exemplified coupler (II-3) | Exemplified Coupler (I-A-2) | Comparative Example |
| 210 | Exemplified coupler (III-1) | Exemplified coupler (II-3) | Exemplified Coupler (I-B-1) | Comparative Example |
| 211 | Exemplified coupler (III-1) | Exemplified coupler (II-3) | Exemplified Coupler (I-B-2) | Comparative Example |
| 212 | Exemplified coupler (III-1) | Exemplified coupler (II-3) | Comparative Coupler CR-1 | Comparative Example |
| 213 | Exemplified coupler (III-1) | Exemplified coupler (II-3) | Comparative Coupler CR-2 | Comparative Example |
| 214 | Exemplified coupler (III-1) | Exemplified coupler (II-3) | Comparative Coupler (CR-1)/(CR-2) (1:1) | Comparative Example |
| 215 | Exemplified coupler (III-1) | Exemplified coupler (II-3) | Exemplified Coupler (I-A-1) | Comparative Example |

Note:
*Ratio in molar ratio

The thus-prepared silver halide photographic materials were subjected to exposure to light imagewise and to a continuous processing (running test) according to the processing steps described below by using a paper-processor until the replenishing amount reached to 2-times as much as the tank volume.

| Processing Step | Temperature | Time | Replenisher* | Tank Capacity |
|---|---|---|---|---|
| Color Development | 35° C. | 45 sec. | 161 ml | 17 l |
| Bleach-fixing | 30-36° C. | 45 sec. | 218 ml | 17 l |
| Rinsing ① | 30-37° C. | 30 sec. | — | 10 l |
| Rinsing ② | 30-37° C. | 30 sec. | — | 10 l |
| Rinsing ③ | 30-37° C. | 30 sec. | 360 ml | 10 l |
| Drying | 70-80° C. | 60 sec. | | |

Note:
*replenisher amount ml/$m^2$ of photographic material
The rinsing steps were carried out in a 3-tank countercurrent mode from the tank of rinsing ③ towards the tank of rinsing ①.

The composition of each processing solution was as follows:

| | Tank Solution | Replenisher |
|---|---|---|
| Color developer | | |
| Water | 800 ml | 800 ml |
| Ethylenediamine-N,N,N,N-tetra-methylene phosphonic acid | 3.0 g | 3.0 g |
| Hydrazine)-N,N-diacetic acid | 5.0 g | 6.0 g |
| Triethanolamine | 10 g | 10 g |
| Sodium chloride | 1.4 g | — |
| Potassium carbonate | 25 g | 25 g |

-continued

| | | |
|---|---|---|
| N-Ethyl-N-(β-methanesulfonamidoethyl)-3-methyl-4-aminoaniline sulfate | 5.0 g | 7.0 g |
| Fluorescent whitening agent (WHITEX-4, made by Sumitomo Chemical Ind.) | 1.0 g | 2.0 g |
| Water to make | 1000 ml | 1000 ml |
| pH | 10.05 | 10.45 |
| Bleach-fixing solution (Both tank solution and replenisher | | |
| Water | 400 ml | |
| Ammonium thiosulfate (700 g/l) | 120 ml | |
| Sodium sulfite | 17 g | |
| Iron (III) ammonium ethylenediamine-tetraacetate dihydrate | 55 g | |
| Disodium ethylenediaminetetraacetate | 5 g | |
| Ammonium bromide | 40 g | |
| Glacial acetic acid | 9 g | |
| Water to make | 1000 ml | |
| pH (25° C.) | 5.40 | |
| Rinsing Solution (both tank solution and replenisher) | | |
| Ion-exchanged water (each content of calsium and magnesium was 3 ppm or below) | | |

Samples that have color image formed by the above process subjected to tests for determining maximum density of each color, the density of cyan stain at unexposed part, and preservation properties to light and dark and hot storage (under the same conditions as in Example 1). Results are shown in Table 4.

TABLE 4

| Sample | Cyan Stain Density | Maximum Density Y | M | C | Preservation Property Light Y | M | C | Dark & Hot Y | M | C | Remarks |
|---|---|---|---|---|---|---|---|---|---|---|---|
| 201 | 0.07 | 2.43 | 2.53 | 2.53 | 88 | 90 | 91 | 94 | 94 | 93 | This Invention |
| 202 | 0.07 | 2.41 | 2.53 | 2.54 | 90 | 91 | 92 | 92 | 95 | 94 | This Invention |
| 203 | 0.08 | 2.42 | 2.54 | 2.53 | 88 | 89 | 90 | 94 | 96 | 93 | This Invention |
| 204 | 0.07 | 2.43 | 2.52 | 2.54 | 86 | 88 | 90 | 92 | 96 | 94 | This Invention |
| 205 | 0.07 | 2.42 | 2.50 | 2.53 | 90 | 91 | 90 | 90 | 95 | 95 | This Invention |
| 206 | 0.06 | 2.41 | 2.51 | 2.52 | 88 | 89 | 90 | 90 | 95 | 94 | This Invention |
| 207 | 0.07 | 2.39 | 2.50 | 2.53 | 90 | 89 | 90 | 92 | 96 | 96 | This Invention |
| 208 | 0.08 | 2.38 | 2.50 | 2.52 | 86 | 88 | 90 | 94 | 96 | 96 | This Invention |
| 209 | 0.07 | 2.41 | 2.52 | 2.42 | 90 | 90 | 86 | 92 | 95 | 93 | Comparative Example |
| 210 | 0.16 | 2.41 | 2.53 | 2.53 | 88 | 90 | 90 | 94 | 94 | 82 | Comparative Example |
| 211 | 0.17 | 2.41 | 2.51 | 2.53 | 90 | 88 | 90 | 96 | 93 | 80 | Comparative Example |
| 212 | 0.12 | 2.42 | 2.50 | 2.47 | 88 | 90 | 72 | 94 | 93 | 94 | Comparative Example |
| 213 | 0.13 | 2.42 | 2.49 | 2.35 | 89 | 88 | 65 | 90 | 94 | 98 | Comparative Example |
| 214 | 0.11 | 2.38 | 2.50 | 2.48 | 86 | 89 | 76 | 92 | 96 | 90 | Comparative Example |
| 215 | 0.07 | 2.41 | 2.52 | 2.42 | 89 | 90 | 86 | 94 | 94 | 93 | Comparative Example |

As is apparent from the results of Table 4, by comparison between samples 201 to 208 of the present invention and samples 209 to 215 which used comparative couplers, it can be understood that the samples of the present invention exhibited superior performance such as good color-balance of image, less cyan stain, and good preservation properties to light and under dark and hot storage.

EXAMPLE 3

Samples 201 to 215 that were prepared in Example 2 were evaluated by the same procedure as in Example 2, except that development processing method was changed to the method described below. Results are shown in Table 5.

| Processing steps | | |
|---|---|---|
| Step | Temperature | Time |
| Color Development | 35° C. | 45 sec. |
| Bleach-fixing | 30–36° C. | 45 sec. |
| Stabilizing (1) | 30–37° C. | 20 sec. |
| Stabilizing (2) | 30–37° C. | 20 sec. |
| Stabilizing (3) | 30–37° C. | 20 sec. |
| Stabilizing (4) | 30–37° C. | 30 sec. |
| Drying | 70–85° C. | 60 sec. |

Note:
Stabilizing steps were carried out in a 4-tank countercurrent mode from the tank of stabilizing (4) toward the tank of stabilizing (1).

The composition of the respective processing solution were as follows:

| | |
|---|---|
| Color developer | |
| Water | 800 ml |
| Ethylenediaminetetraacetic acid | 2.0 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,-N-diethylhydroxylamine | 4.2 g |
| 5,6-Dihydroxybenzene-1,2,4-trisulfonic acid | 0.3 g |
| Fluoroescent brightening agent (4,4'-diaminostilbene series) | 2.0 g |
| Water to make | 1000 ml |
| pH (25° C.) | 10.10 |
| Bleach-fixing solution | |
| Water | 400 ml |
| Ammonium thiosulfate (700 g/l) | 100 ml |
| Sodium sulfite | 1.8 g |
| Iron (III) ammonium ethylenediamine-tetraacetate dihydrate | 55 g |
| Disodium ethylenediaminetetraacetate | 3 g |
| Glacial acetic acid | 8 g |
| Water to make | 1000 ml |
| pH (25° C.) | 5.5 |
| Stabilizing solution | |

-continued

| | |
|---|---|
| Formalin (37%) | 0.1 g |
| Formalin-sulfurous acid adduct | 0.7 g |
| 5-Chloro-2-methyl-4-isothiazolin-3-one | 0.02 g |
| 2-Methyl-4-isothiazolin-3-one | 0.01 g |
| Copper sulfate | 0.005 g |
| Water to make | 1000 ml |
| pH (25° C.) | 4.0 |

TABLE 5

| Sample | Cyan Stain Density | Maximum Density Y | M | C | Preservation Property Light Y | M | C | Dark & Hot Y | M | C | Remarks |
|---|---|---|---|---|---|---|---|---|---|---|---|
| 201 | 0.07 | 2.43 | 2.53 | 2.53 | 90 | 91 | 92 | 94 | 93 | 93 | This Invention |
| 202 | 0.07 | 2.40 | 2.52 | 2.54 | 91 | 91 | 90 | 90 | 93 | 94 | This Invention |
| 203 | 0.07 | 2.41 | 2.53 | 2.53 | 90 | 89 | 91 | 94 | 96 | 93 | This Invention |
| 204 | 0.07 | 2.42 | 2.51 | 2.54 | 88 | 88 | 90 | 92 | 95 | 94 | This Invention |
| 205 | 0.07 | 2.41 | 2.52 | 2.53 | 90 | 90 | 90 | 90 | 95 | 95 | This Invention |
| 206 | 0.06 | 2.40 | 2.51 | 2.52 | 89 | 89 | 90 | 90 | 95 | 94 | This Invention |
| 207 | 0.07 | 2.39 | 2.50 | 2.53 | 90 | 89 | 90 | 92 | 94 | 96 | This Invention |
| 208 | 0.07 | 2.38 | 2.50 | 2.52 | 89 | 88 | 90 | 94 | 96 | 96 | This Invention |
| 209 | 0.07 | 2.40 | 2.50 | 2.42 | 89 | 90 | 86 | 92 | 94 | 93 | Comparative Example |
| 210 | 0.16 | 2.41 | 2.51 | 2.53 | 88 | 90 | 90 | 94 | 93 | 82 | Comparative Example |
| 211 | 0.18 | 2.41 | 2.50 | 2.53 | 90 | 88 | 90 | 96 | 93 | 80 | Comparative Example |
| 212 | 0.11 | 2.41 | 2.50 | 2.46 | 89 | 90 | 72 | 94 | 93 | 95 | Comparative Example |
| 213 | 0.13 | 2.42 | 2.49 | 2.35 | 89 | 88 | 65 | 90 | 94 | 98 | Comparative Example |
| 214 | 0.11 | 2.38 | 2.50 | 2.48 | 86 | 89 | 76 | 92 | 96 | 90 | Comparative Example |
| 215 | 0.07 | 2.41 | 2.50 | 2.42 | 88 | 90 | 86 | 93 | 94 | 93 | Comparative Example |

As is apparent from the results of Table 5, by comparison between samples 201 to 208 of the present invention and samples 209 to 215 which used comparative couplers, it can be understood that the samples of the present invention exhibited superior performance with respect to color-balance of image, cyan stain, and preservation properties to light and under dark and hot conditions.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide color photographic material, which comprises at least one open coupler represented by formula (IV-A) given below and at least one cyan coupler represented by formula (IV-B) given below:

Formula (IV-A)

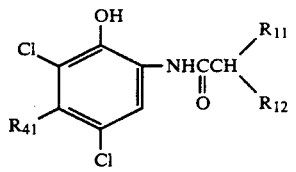

wherein $R_{41}$ represents an ethyl group and $R_{11}$ and $R_{12}$ represent independently an alkyl group with the total number of carbon atoms in the alkyl groups $R_{11}$ and $R_{12}$ being 12 to 36;

Formula (IV-B)

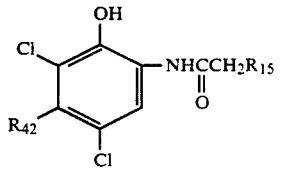

wherein $R_{42}$ represents an ethyl group and $R_{15}$ represents an alkyl group having 8 or more carbon atoms.

2. The silver halide color photographic material as claimed in claim 1, which comprises at least three photosensitive silver halide emulsion layers different in color sensitivity on a base, including a first color-sensitive photosensitive layer containing the at least one cyan coupler represented by formula (IV-A) and the at least one cyan coupler represented by formula (IV-B), a second color-sensitive photosensitive layer containing at least one magenta coupler represented by formula (II) given below, and a third color-sensitive layer containing at least one yellow coupler represented by formula (III) given below:

Formula (II)

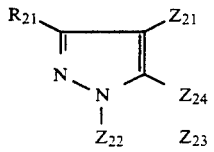

wherein $R_{21}$ represents a hydrogen atom or a group capable of substitution, $Z_{21}$ represents a hydrogen atom or a group or an atom that is capable of being released upon coupling reaction which the coupler couples with the oxidized product of an aromatic primary amine color-developing agent, $Z_{22}$, $Z_{23}$, and $Z_{24}$ each represent

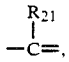

—N=, or —NH—, one of $Z_{24}$-$Z_{23}$ bond and the $Z_{23}$-$Z_{22}$ bond is a double bond, the other is a single bond, and when $Z_{23}$-$Z_{22}$ is a carbon-carbon double bond, it may be part of an aromatic ring, Formula (III):

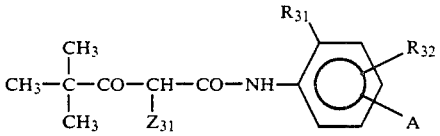

wherein $R_{31}$ represents a halogen atom, an alkoxy group, a trifluoromethane group, or an aryl group, $R_{32}$ represents a hydrogen atom, a halogen atom, or an alkoxy group, A represents —$NHCOR_{33}$, —$NHSO_2$—$R_{33}$, —$SO_2NHR_{33}$, —$COOR_{33}$, or

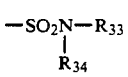

in which $R_{33}$ and $R_{34}$ each represent an alkyl group, an aryl group, or an acyl group, and $Z_{31}$ represents a hydrogen atom or a group or an atom that is capable of being released upon coupling reaction which the coupler couples with the oxidized product of an aromatic primary amine color-developing agent.

3. The silver halide color photographic material as claimed in claim 2, wherein $R_{33}$ and $R_{34}$ have 10 to 32 carbon atoms.

4. The silver halide color photographic material as claimed in claim 2, wherein $R_{31}$ is a ballasting group having 8 or more carbon atoms.

5. The silver halide color photographic material as claimed in claim 2, wherein the magenta coupler represented by formula (II) is a magenta coupler represented by the following formula (V):

Formula (V)

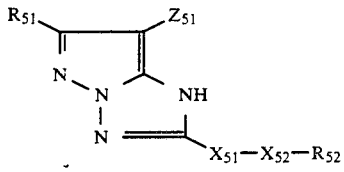

wherein $Z_{51}$ represents an hydrogen atom, a halogen atom, an aryl group, or an arylthio group, $R_{51}$ represents an alkyl group, an alkoxy group, or an aryloxy group, $X_{51}$ represents an alkylene group, and arylene group, or an aralkylene group, $X_{52}$ represents a group —$NHSO_2$— or a group

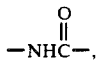

and $R_{52}$ represents an aryl group or an alkyl group.

6. The silver halide color photographic material as claimed in claim 2, wherein the yellow coupler represented by formula (III) is a yellow coupler represented by the following formula (VI):

Formula (VI)

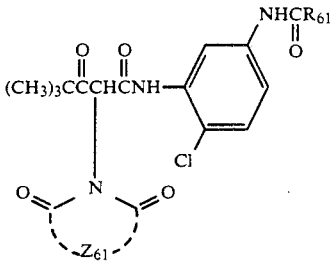

wherein $R_{61}$ represents an unsubstituted alkyl group having 1 to 32 carbon or an aryloxy-substituted alkyl group having 7 to 32 carbon atoms, and $Z_{61}$ represents a group of nonmetal atoms required to complete a 5- or 6-membered ring together with

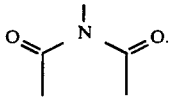

7. The silve halide color photographic material as claimed in claim 1, wherein the couplers (IV-A) and (IV-B) are contained in a red sensitive silver halide emulsion layer constituting photosensitive layers in an amount of 0.1 to 1.0 mol per mol of silver halide.

8. The silver halide color photographic material as claimed in claim 1, wherein the molar ratio of couplers represented by formula (IV-A) and (IV-B) is in the range of 1:0.6 to 1:1.4.

9. The silver halide color photographic material as claimed in claim 2, wherein the couplers represented by formulae (IV-A), (IV-B), (II), and (III) are contained in silver halide emulsion layers constituting photosensitive layers in an amount of 0.1 to 1.0 mol per mol of silver halide.

10. The silver halide color photographic material as claimed in claim 2, wherein the molar ratio of couplers represented by formula (IV-A), (IV-B), (II), and (III) is in the range of 1:0.6–1.4:0.2–1.5:0.6–2.0.

11. The silver halide color photographic material as claimed in claim 1, wherein $R_{15}$ represents an alkyl group having 8 to 30 carbon atoms.

12. The silver halide color photographic material as claimed in claim 5, wherein $R_{51}$ is an alkyl group having up to 4 carbon atoms.

* * * * *